US006328635B1

(12) United States Patent
Suzuki et al.

(10) Patent No.: US 6,328,635 B1
(45) Date of Patent: Dec. 11, 2001

(54) DEVICE FOR THE DISPLAY OF ENGRAVEMENT SHAPE OF EYEGLASS LENS AND METHOD AND APPARATUS FOR MACHINING LENS PERIPHERAL EDGE USING THE DISPLAY DEVICE

(75) Inventors: Yasuo Suzuki; Takeshi Nakamura, both of Tokyo (JP)

(73) Assignee: Kabushiki Kaisha Topcon, Tokyo (JP)

( * ) Notice: Subject to any disclaimer, the term of this patent is extended or adjusted under 35 U.S.C. 154(b) by 0 days.

(21) Appl. No.: 09/521,426

(22) Filed: Mar. 8, 2000

(30) Foreign Application Priority Data

Mar. 8, 1999 (JP) ..... 11-060750

(51) Int. Cl.[7] ..... B24B 1/00

(52) U.S. Cl. ..... 451/43; 451/5; 451/8; 451/42; 451/43; 451/255; 451/256

(58) Field of Search ..... 451/42, 43, 255, 451/256, 240, 5, 8

(56) References Cited

U.S. PATENT DOCUMENTS 6,045,432 * 4/2000 Shibata ..... 451/5
6,074,280 * 6/2000 Mizuno et al. ..... 451/42
6,089,957 * 7/2000 Shibata ..... 451/41

* cited by examiner

*Primary Examiner*—Joseph J. Hail, III
*Assistant Examiner*—Shantese McDonald
(74) *Attorney, Agent, or Firm*—Oblon, Spivak, McClelland, Maier & Neustadt, P.C.

(57) ABSTRACT

A lens peripheral edge machining apparatus includes a judging device which judges the type of each of eyeglass lenses on the basis of an edge thickness shape thereof and which classifies the eyeglass lenses into groups, a display which displays the groups to which the eyeglass lenses belong in a distinguishable manner on the basis of the result of the judgment made by the judging device, an engravement information adjuster which adjusts engravement information at an arbitrary circumferential edge position of the other lens peripheral shape in accordance with the group information to which one eyeglass lens belongs and the group information to which the other eyeglass lens belongs both displayed on the display, and a machining controller which makes controller to machine a peripheral edge of the other eyeglass lens in accordance with engravement information after the adjustment.

3 Claims, 18 Drawing Sheets

60
66
C
81
81b
81c
81d
S1(S2)
D
83
B2
502
402
B1
402a
501
501a
501b
502b
86b
501c
502c
85
502a
80
86a
86
BA
89(90)
Sa(Sb)
87
88
84
82
83'
83a
BT
90
Sb
Sa
89

DEVICE FOR THE DISPLAY OF ENGRAVEMENT SHAPE OF EYEGLASS LENS AND METHOD AND APPARATUS FOR MACHINING LENS PERIPHERAL EDGE USING THE DISPLAY DEVICE

BACKGROUND OF THE INVENTION

1. Field of the Invention

The present invention relates to a device for the display of engravement shape of an eyeglass lens and a method and apparatus for machining a peripheral edge of the lens using the display device.

2. Description of the Related Art

According to the prior art, in a lens grinder (a lens peripheral edge machining apparatus), an eyeglass lens for the right-hand eye is subjected to grinding in accordance with a lens peripheral shape of one (right-hand eye) eyeglass frame portion and thereafter an eyeglass lens for the left-hand eye is subjected to grinding in accordance with a lens peripheral shape of the other (left-hand eye) eyeglass frame portion. A certain lens grinder of this type is provided with a display device which displays engravement information by engravement simulation before grinding so that right and left eyeglass lenses can be fitted tastefully into the eyeglass frame. In such a lens grinder, an estimated engravement shape after the machining is displayed on the display device by engravement simulation, the worker for the machining is allowed to recognize at which position from a front end of an eyeglass lens on the lens edge face a vertex position between engravements after the grinding work is formed, and thereafter eyeglass lenses for the right and left eyes are subjected to grinding.

As eyeglass lenses, various lenses are available, including plastic lenses, flat lenses, and minus lenses. In the conventional lens peripheral edge machining apparatus, for the purpose of fitting eyeglass lenses into an eyeglass frame tastefully, a division ratio, which is defined in terms of a ratio between the distance from a front end of each lens on the lens edge face up to a vertex position between engravements and the distance from the vertex position between engravements to a rear end of the lens, is set, for example, at 4:6 in case of a plus lens, 5:5 in case of a flat lens, and 3:7 in case of a minus lens, and engravement is subjected to grinding in this condition.

On the other hand, a certain eyeglasses wearer wears eyeglass lenses which are markedly different in their degrees between the right and left eyes. For example, a certain eyeglasses wearer wears a plus lens for the right-hand eye and a minus lens for the left-hand eye. If a plus lens is subjected to grinding and engravement is formed at a division ratio established for the plus lens, while if a minus lens is subjected to grinding and engravement is formed at a division ratio established for the minus lens, and when eyeglass lenses for the right and left eyes are fitted in right and left lens frame portions, respectively, of an eyeglass frame, one eyeglass lens looks protruding too much from the front side of the lens frame in comparison with the other eyeglass lens, that is, both lenses do not look protruding uniformly from the lens frame front side, thus giving rise to the problem that the eyeglasses when put on its wearer look poor.

SUMMARY OF THE INVENTION

It is a first object of the present invention to provide a device for the display of engravement shape of an eyeglass lens which, when an eyeglass lens for the right-hand eye of and an eyeglass lens for the left-hand eye of a wearer are of different types, can allow a worker who machines the lenses to recognize to that effect.

It is a second object of the present invention to provide a method and apparatus for machining a peripheral edge of an eyeglass lens which, even when an eyeglass lens for the right-hand eye of and an eyeglass lens for the left-hand eye of a wearer are of different types, can grind the eyeglass lenses so that the lenses can be fitted in an eyeglass frame tastefully.

For achieving the above-mentioned objects, according to the present invention, in a first aspect thereof, there is provided a device for the display of engravement shape of an eyeglass lens, comprising an edge thickness measuring means which measures, as an edge thickness, the thickness of each of unmachined eyeglass lenses at the portion of a lens peripheral shape of an eyeglass frame on the basis of data on lens peripheral shape of the eyeglass frame, a judging means which judges the type of each of the eyeglass lenses on the basis of the shape of the edge thickness and which classifies the eyeglass lenses into groups, and a display which displays, as an estimated engravement shape, the engravement shape of an edge end after each of the eyeglass lenses has been machined along the lens peripheral shape and which displays the groups to which the eyeglass lenses belong in a distinguishable manner on the basis of the result of the judgment made by the judging means.

In a second aspect of the present invention there is provided a method for machining a peripheral edge of an eyeglass lens, comprising classifying unmachined right and left eyeglass lenses into groups in accordance with edge thickness shapes at lens peripheral shape portions of right and left eyeglass lens frame portions of an eyeglass frame, displaying on a display the groups to which the right and left eyeglass lenses belong in a recognizable manner, machining a peripheral edge of one unmachined eyeglass lens in accordance with data on one lens peripheral shape out of the right and left eyeglass lens frame portions, then when a peripheral edge of the other unmachined eyeglass lens is to be machined in accordance with data on the other lens peripheral shape out of the right and left eyeglass frame portions, adjusting engravement information at an arbitrary circumferential edge position of the other lens peripheral shape in accordance with the group information to which one eyeglass lens belongs and the group information to which the other eyeglass lens belongs both displayed on the display, and machining the peripheral edge of the other eyeglass lens in accordance with the thus-adjusted engravement information.

In a third aspect of the present invention there is provided an apparatus for machining a peripheral edge of an eyeglass lens, comprising an edge thickness measuring means which measures, as an edge thickness, the thickness of each of unmachined eyeglass lenses at the portion of a lens peripheral shape of an eyeglass frame on the basis of data on lens peripheral shape of the eyeglass frame, a judging means which judges the type of each of the eyeglass lenses on the basis of the shape of the edge thickness and which classifies the eyeglass lenses into groups, a display which displays, as an estimated engravement shape, the engravement shape of an edge end after each of the eyeglass lenses has been machined along the lens peripheral shape and which displays the groups to which the eyeglass lenses belong in a recognizable manner on the basis of the result of the judgment made by the judging means, an engravement information adjusting means which adjusts engravement information at an arbitrary circumferential edge position of the other lens peripheral shape in accordance with the group information to which one eyeglass lens belongs and the group information to which the other eyeglass lens belongs both displayed on the display, and a machining control means which makes control to machine a peripheral edge of the other eyeglass lens in accordance with engravement information after the adjustment.

According to the present invention summarized above, after the peripheral edge of one eyeglass lens has been machined on the basis of one lens peripheral shape, when the peripheral edge of the other eyeglass lens is to be machined on the basis of the other lens peripheral shape, it is possible to recognize to which of plus lens, flat lens, and minus lens, (including special lenses such as progressive multi-focus lenses), groups the eyeglass lenses for the right and left eyes belong respectively and then adjust engravement information to effect engravement-grinding. Therefore, even if the eyeglass lenses for the right and left eyes are of different degrees, it is possible to fit them into an eyeglass frame tastefully.

BRIEF DESCRIPTION OF THE DRAWINGS

The above and other objects, features and advantages of the present invention will become more apparent from the following description taken in connection with the accompanying drawings, in which:

FIG. 9(*b*) is an explanatory view showing a closed state at a position along line C—C in FIG. 9(*a*), FIG. 9(*c*) is a sectional view in an open state along line C—C in FIG. 9*b*), and FIG. 9(*d*) is an explanatory view showing the arrangement of a microswitch illustrated in FIG. 9(*a*);

DESCRIPTION OF THE PREFERRED EMBODIMENTS

A device for the display of engravement shape of an eyeglass lens, as well as a method and apparatus for machining a peripheral edge of an eyeglass lens using the display device, according to an embodiment of the present invention, will be described hereinunder with reference to the drawings.

<Grinding Section>

Figure 1:
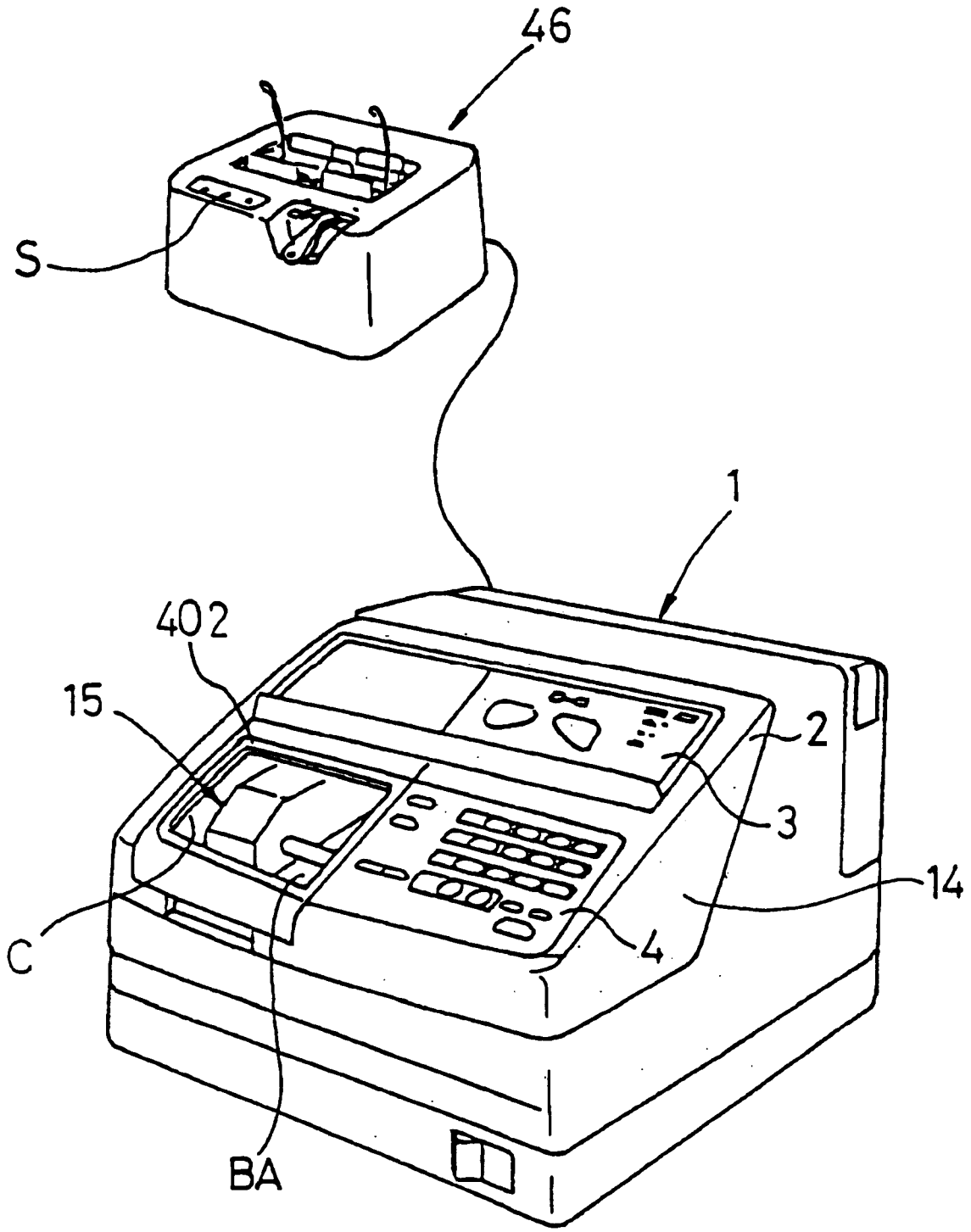
FIG. 1 is an appearance diagram of a lens peripheral edge machining apparatus (lens grinder) according to the present invention.

In FIG. 1, the numeral 1 denotes a box-like body of lens grinder, numeral 2 denotes a slant surface formed in a front upper portion of the body 1, numeral 3 denotes a liquid crystal display portion provided in a half of the right-hand side of the slant surface 2, and numeral 4 denotes a keyboard portion (operating panel portion) provided in a lower portion of the right-hand side of the slant face 2.

Figure 2:
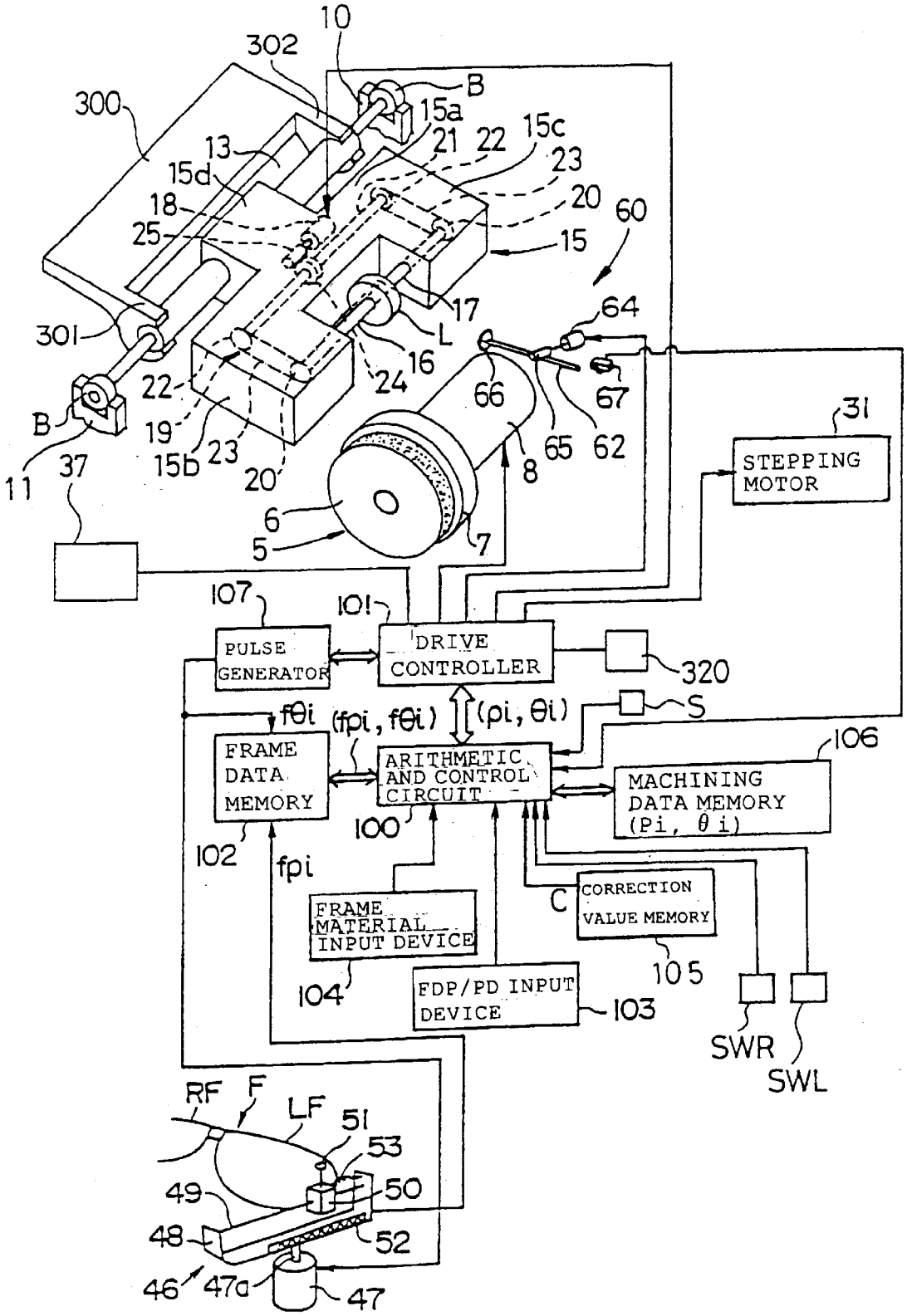
FIG. 2 is a diagram showing a control circuit used in the apparatus.

On the left-hand side of the body 1 is formed a machining chamber BA which will be described later. On the bottom side of the machining chamber BA is disposed a grindstone 5 which is supported rotatably by the body 1, as shown in FIG. 2. The grindstone 5 comprises a rough grindstone 6 and a V-groove grindstone 7 and is rotated by means of a motor 8.

Figure 3:
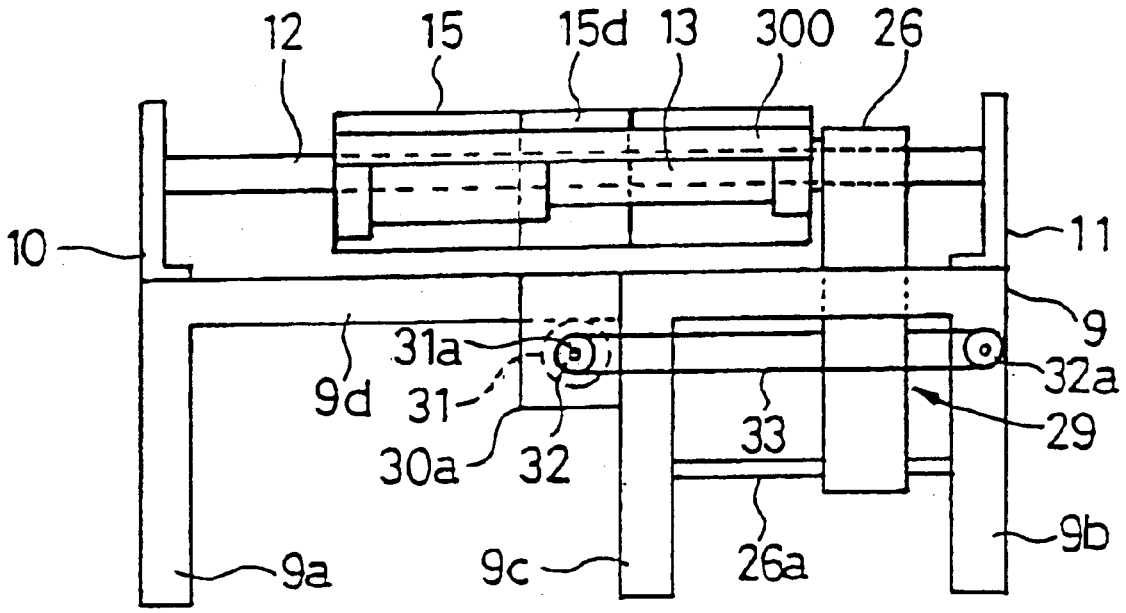
FIG. 3 is a schematic rear view of a carriage mounting portion shown in FIG. 2.

A support table 9 for supporting a carriage is fixed within the body 1 as shown in FIG. 3. The support table 9 has left and right leg portions 9*a*, 9*b*, an intermediate leg portion 9*c* located between the leg portions 9*a* and 9*b* at a position offset to the leg portion 9*b* side, and a mounting plate portion 9*d* which is contiguous to upper ends of the leg portions 9*a*–9*c*.

On both side positions of the mounting plate portion 9*d* are erected shaft mounting brackets 10 and 11. As shown in FIG. 2, bearings B are fitted respectively on both right and left end portions of a support shaft (a swing shaft or a rotary shaft) 12 and are held on the brackets 10 and 11. Further, a sleeve (a swing sleeve) 13 is fitted on an outer periphery of the support shaft 12 so as to be movable axially. The support shaft 12 and the sleeve 13 are covered with a cover 14 shown in FIG. 1.

Figure 4:
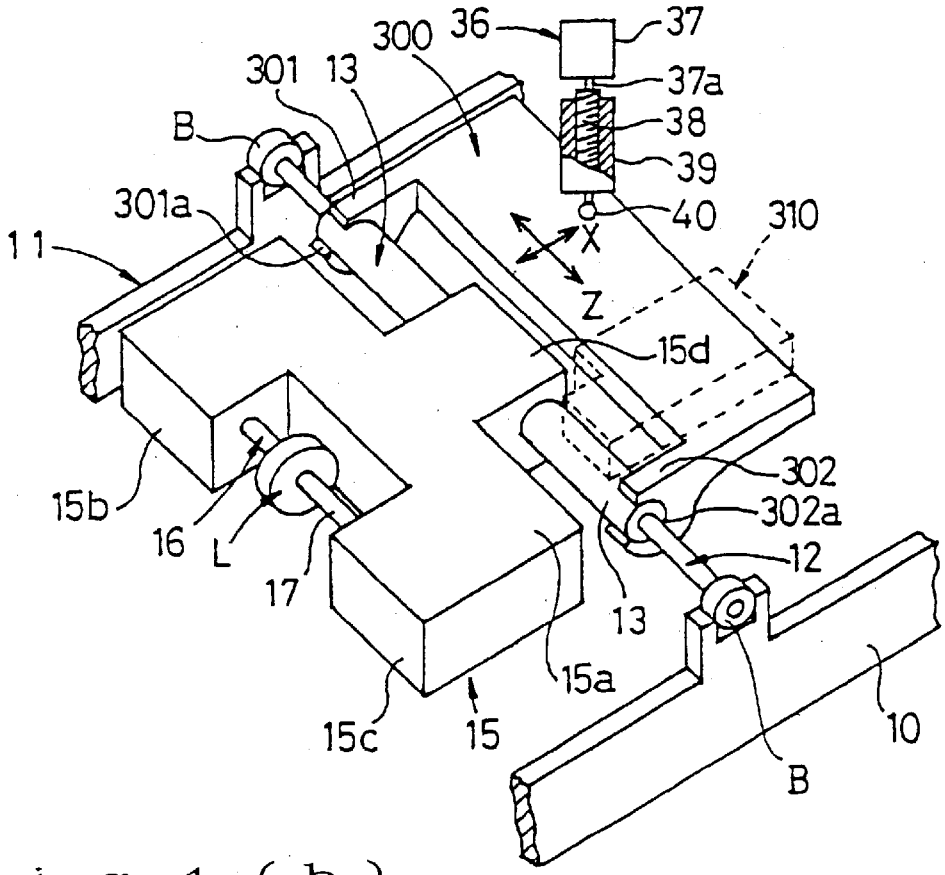
FIG. 4(*a*) is a partial schematic perspective view showing a relation between a carriage and a swing arm both illustrated in FIG. 2 and FIG. 4(*b*) is a perspective view for explaining a machining pressure adjusting means shown in FIG. 4(*a*)
Figure 4:
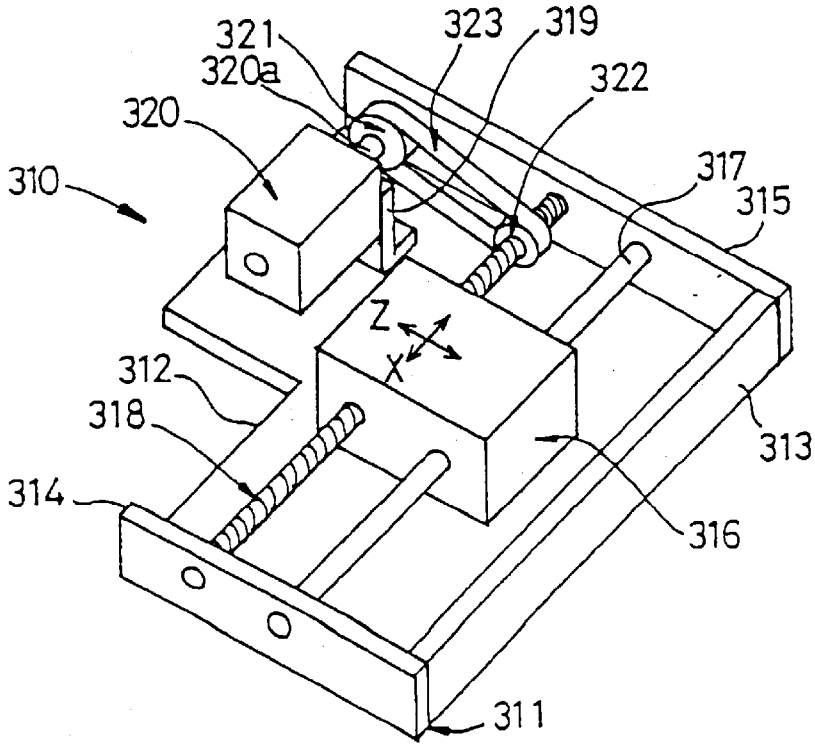

As shown in FIGS. 4(*a*) and 4(*b*), a carriage 15, as well as a plate-like swing arm 300 and a machining pressure adjusting unit 310 attached to the swing arm 300, are disposed inside the cover 14.

Figure 5:
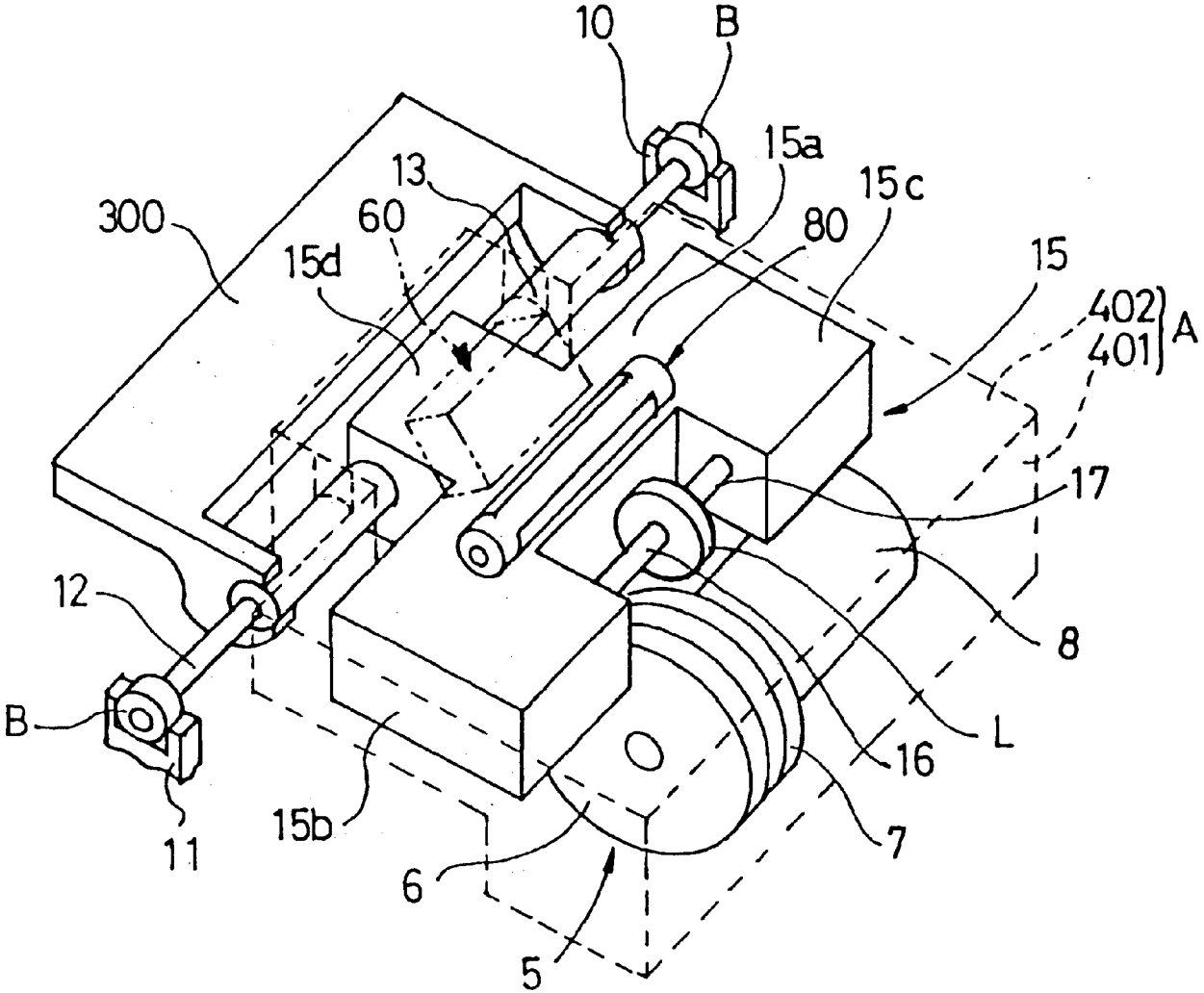
FIG. 5 is a schematic perspective view showing the arrangement of a waterproof cover used in the apparatus shown in FIG. 2.

As shown in FIG. 5, a water receiving vessel A, which is covered with the cover 14, is installed within the body 1. The water receiving vessel A comprises a lower water receiving cover (a water receiving vessel body) 401 which is open upward and an upper water receiving cover 402 which closes the upper open end of the water receiving cover 401. The machining chamber BA is formed within the water receiving vessel A, and the grindstone 5 and the carriage 15 are disposed within the machining chamber BA.

Besides, the carriage 15 can swing vertically within the machining chamber BA. The swing arm 300, etc. are disposed so as to be outside the water receiving cover 401. As shown in FIG. 1, an opening C for taking in and out of a lens L to be machined is formed as a window (opening/closing window) for taking in and out of the lens. The opening C is opened and closed by a window cover (not shown), thereby allowing the lens L to be taken in and out of the machining chamber.

Figure 6:
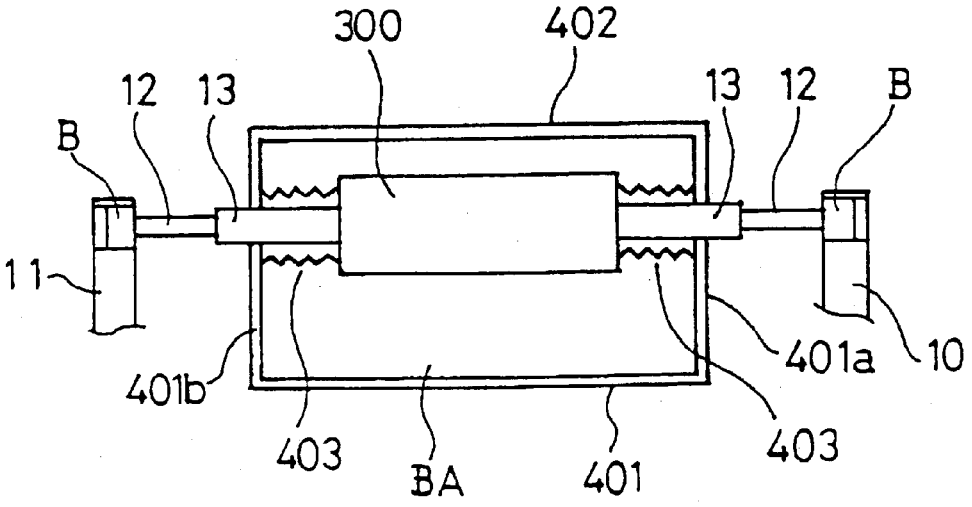
FIG. 6 is a sectional view taken along line A—A in FIG. 8.

As shown in FIG. 6, moreover, a pair of waterproofing bellows 403 are mounted between the carriage 15 and side walls 401*a*, 401*b* of the water receiving cover 401.

<Carriage>

As shown in FIG. 5, the carriage 15 comprises a carriage body 15*a*, arm portions 15*b* and 15*c* which are formed integrally toward the front on both sides of the carriage body 15*a* and which are parallel to each other, and a projection 15*d* projecting backward from a central position of a rear edge portion of the carriage body 15*a*. The sleeve 13 extends right and left through the projection 15*d* and is fixed to the projection 15*d*, whereby a front end portion of the carriage 15 can turn vertically, centered on the support shaft 12.

A lens rotating shaft 16 is held rotatably by the arm portion 15*b* of the carriage 15, while a lens rotating shaft 17, which is coaxial with the lens rotating shaft 16, is held by the arm portion 15*c* of the carriage 15 so that it can rotate and can be adjusted forward and backward relative to the lens rotating shaft 16. The lens L to be machined is held between the opposed ends (one ends) of the lens rotating shafts 16 and 17.

The lens rotating shafts 16 and 17 are rotated by a shaft rotating drive unit (shaft rotating drive means). As shown in FIG. 2, the shaft rotating drive unit comprises a pulse motor 18 fixed within the carriage body 15*a* and a power transfer mechanism (power transfer means) 19 for transmitting the rotation of the pulse motor 18 to the lens rotating shafts 16 and 17.

The power transfer mechanism 19 comprises a pair of timing pulleys 20 mounted respectively on the lens rotating shafts 16 and 17, a rotary shaft 21 held rotatably by the carriage body 15*a*, a pair of timing pulleys 22 fixed respectively onto both end portions of the rotary shaft 21, a timing belt 23 entrained on the timing pulleys 20 and 22, a gear 24 fixed onto the rotary shaft 21, and a pinion 25 for output of the pulse motor 18.

Figure 7:
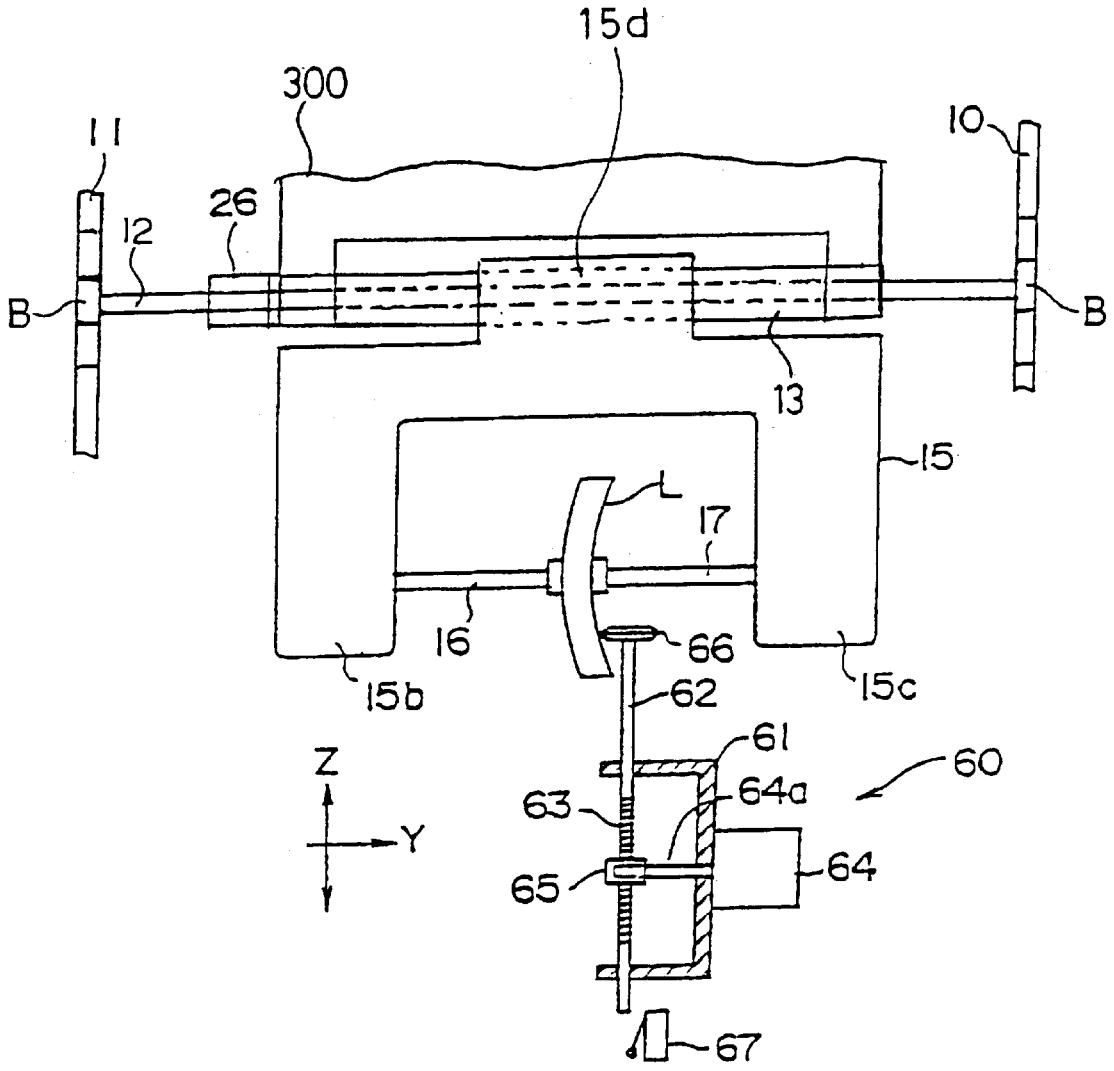
FIG. 7 is a schematic explanatory plan view showing a relation between the carriage and a filler illustrated in FIG. 2.

As shown in FIGS. 3 and 7, an upper end portion of a support arm 26 is held by the support shaft 12 so as to be movable right and left (not shown in FIGS. 2, 4(*a*) and 4(*b*)). The support arm 26 is connected to the sleeve 13 so as to be axially movable integrally with the sleeve 13 and relatively movable about the sleeve axis. As shown in FIG. 3, both end portions of a guide shaft 26*a* parallel to the support shaft 12 are fixed to the leg portions 9*b* and 9*c*. The guide shaft 26*a* extends through a lower end portion of the support arm 26 and guides the support arm movably right and left.

<Carriage Transverse Moving Means>

As shown in FIG. 3, the carriage 15 is installed so as to be movable right and left by a carriage transverse moving means 29.

The carriage transverse moving means 29 comprises a mounting plate 30*a* fixed to both the leg portion 9*c* and the mounting plate portion 9*d*, a stepping motor 31 fixed to a front side of the mounting plate 30*a*, a pulley 32 fixed onto an output shaft 31*a* which projects to the rear side through the mounting plate 30*a*, a pulley 32*a* attached to the back of the leg portion 9*b* rotatably, and a wire 33 wound the pulleys 32 and 32*a* and whose both ends are fixed to the support arm 26.

<Swing Arm 300>

The swing arm 300 is formed by a plate member as noted previously. As shown in FIGS. 2 and 4(*a*), projections 301 and 302 projecting forward are formed at both end portions in the transverse direction (Z direction) of the swing arm 300. Semicircular holding portions 301*a* and 302*a* are formed at front end portions of the projections 301 and 302, respectively. The holding portions 301*a* and 302*a* are fitted on both end portions of the sleeve 13 fixedly by a fixing means such as machine screws or an adhesive not shown.

<Machining Pressure Adjusting Means 310>

As shown in FIG. 4(*b*), the machining pressure adjusting means 310 has a mounting frame 311 as a mounting base. The mounting frame 311 comprises a base plate 312 disposed in parallel with the swing arm 300 on the underside of one side portion of the swing arm 300, a side plate 313 extending in the longitudinal direction (X direction) and fixed to the right-hand side of the base plate 312, a front side plate 314 fixed to a front edge portion of the base plate 312 and also to the side plate 313, and a rear side plate 315 fixed to a rear edge portion of the base plate 312 and also to the side plate 313. The mounting frame 313 is fixed to the underside of the swing arm 300 through brackets or machine screws (neither shown).

The machining pressure adjusting means 310 is further provided with a cubic weight 316 disposed above the base plate 312, a guide shaft 317 extending in the longitudinal direction (X direction) through the weight 316, and a feed screw 318 threadedly engaged with internal threads (not shown) formed longitudinally in the weight 316, the feed screw 318 extending through the weight 316. Both end portions of the guide shaft 317 are fixed to the side plates 314 and 315, and both end portions of the feed screw 318 are held rotatably by the side plates 314 and 315. The guide shaft 317 and the feed screw 318 are disposed in parallel with each other.

The machining pressure adjusting means 310 is still further provided with a bracket 319 fixed onto the base plate 312, a pulse motor 320 fixed to the bracket 319 and having an output shaft 320*a* extending in the longitudinal direction, a timing gear 321 fixed to the output shaft 320*a* of the pulse motor 320, and a timing belt 323 entrained on timing gears 321 and 322. Rotation of the pulse motor 320 is transmitted to the feed screw 318 via the timing gears 321, 322 and the timing belt 323.

As the pulse motor 320 is rotated forward, the feed screw 318 is rotated forward and the weight 316 is moved to the front side. On the other hand, when the pulse motor 37 is rotated reverse, the feed screw 318 is rotated reverse, so that the weight 316 is moved backward.

<Carriage Lift Means>

A carriage lift means 36 is disposed on a rear edge portion of the swing arm 300. The carriage lift means 36 comprises a pulse motor 37 disposed vertically at an upper position of the swing arm 300 and held within the body 1 through a bracket (not shown), a male screw 38 formed integrally and coaxially with an output shaft 37*a* of the pulse motor 37, an internally threaded sleeve 39 threadedly engaged with the male screw 38 vertically movably, and a spherical urging member 40 integral with a lower end of the internally threaded sleeve 39. The internally threaded sleeve 39 is held within the body 1 through a bracket (not shown) unrotatably about the axis thereof and vertically movably. The urging member 40 is in abutment with an upper surface of the swing arm 300.

<Lens Peripheral Shape Measuring Section (Means)>

As shown in FIG. 2, a lens peripheral shape measuring section 46, a pulse motor 47, a rotary arm 48 mounted on an output shaft 47*a* of the pulse motor 47, a filler support member 50 which is movable longitudinally along a rail 49, a filler 51 (contact piece) supported on the filler support member 50, an encoder 52 for detecting the amount of movement of the filler support member 50, and a spring 53 which urges the filler support member 50 in one direction.

It is optional whether the lens peripheral shape measuring section 46 is to be constituted integrally with the lens machining apparatus or separated from the lens machining apparatus and connected to the apparatus electrically. In the latter case, data on the shape of each lens frame obtained from a lens frame shape measuring device separate from the lens machining apparatus is once inputted into, for example, a floppy disc of an IC card, while the lens machining apparatus is provided with a reader for reading the data from a storage medium. There also may be adopted a construction wherein data on the shape of a lens frame can be inputted into the lens machining apparatus on an on-line basis from an eyeglass frame manufacturer.

<Edge Thickness Measuring Means 60>

Figure 8:
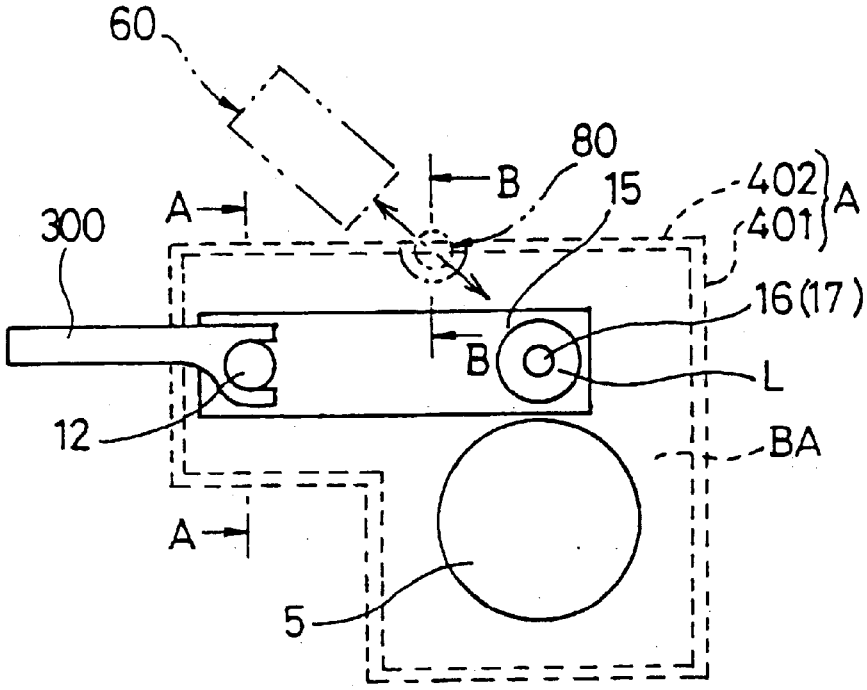
FIG. 8 is a side view of the carriage illustrated in FIG. 7.
Figure 9:
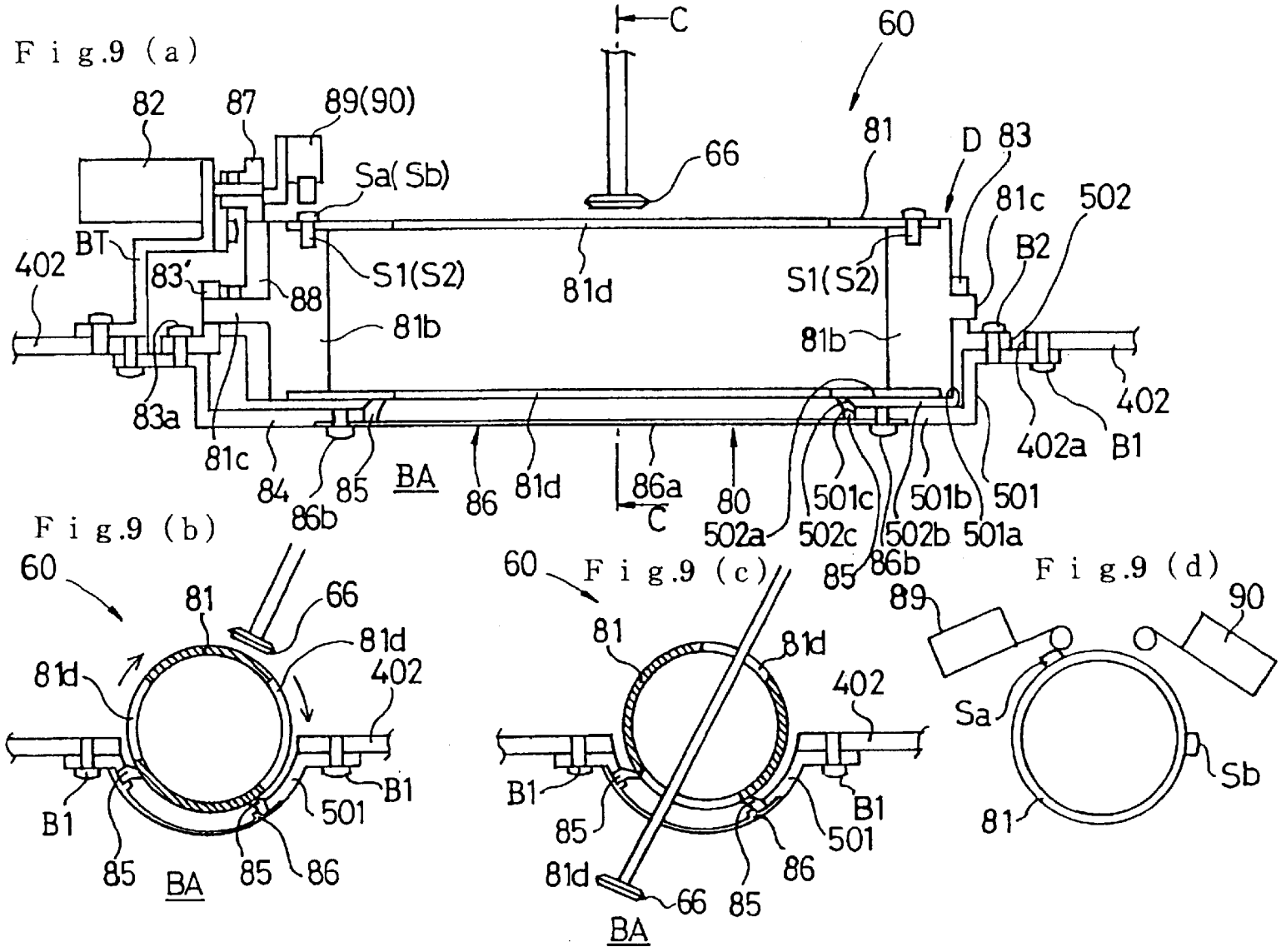
FIG. 9(*a*) is a sectional view taken along line B—B in FIG. 8.

An edge thickness measuring means 60 shown in FIGS. 2 and 7 is separated from the carriage 15 for the convenience of explanation, but actually, for the reduction in size of the carriage 15, it is secured to an upper portion of the upper waterproof cover 402 which covers the carriage 15 from above, as shown in FIGS. 5, 8 and 9(*a*) to 9(*c*). In this case, the edge thickness measuring means 60 is disposed in such a manner that lower side from the swing arm 300 side is inclined forwardly corresponding to the lens L to be machined which is held on the lens rotating shafts 16 and 17.

A filler 66 of the edge thickness measuring means 60 can be taken in and out of the machining chamber BA through an opening 402*a* formed in the upper waterproof cover 402. However when a grinding fluid (water) is fed to a grinding portion from a grinding fluid supply nozzle (not shown) during grinding of the lens L with the grindstone 5, the grinding fluid scatters from the lens L and the grinding portion. To prevent the scattered grinding fluid from soaking into the edge thickness measuring means 60 side through the opening 402*a*, an edge thickness measuring device opening/closing unit 80 is mounted as follows between the machining chamber BA and the edge thickness measuring means 60, that is, on the upper waterproof cover 402 while being positioned in the portion of the openine 402*a*.

The opening 402*a* is closed with a mounting plate 501 which is secured to the upper waterproof cover 402 with machine screws B1. The mounting plate 501 is formed with a recess 501*a* projecting to the machining chamber BA side. An opening 501*c* is formed in a bottom (bottom wall) 501*b* of the recess 501*a*. Within and along the recess 501*a* is fixed a mounting plate 502 with machine screws B2.

The edge thickness measuring device opening/closing unit 80 comprises a bearing (bearing projection) provided projectingly on the mounting plate 502 and positioned on one side of an upper opening end of the recess 502*a*, a bearing (bearing projection) 83' positioned on the opposite side of the upper opening end of the recess 502*a* and fixed to the mounting plate 501 with machine screws 83*a*, and a rotary member D, a lower half of which is positioned within the recess 502*a*. The rotary member D has a cylindrical body (a cylindrical window member) 81, end wall members 81*b* disposed respectively in both end portions of the cylindrical body 81, and machine screws S1 and S2 spaced in the circumferential direction to fix the cylindrical body 81 to the end wall members 81*b*. In FIG. 9(*a*), the numeral 502*b* denotes a bottom (bottom wall) of the mounting plate 502 and numeral 502*c* denotes an opening formed in the bottom 502*b*.

A pair of shaft portions 81*c* of the end wall members 81*b* are held rotatably by the bearings 83 and 83' respectively. In the cylindrical body 81 are formed a pair of longitudinally extending window openings 81*d* in circumferentially 180° spaced fashion. The filler 66 can be taken in and out through the window openings 81*d*.

A presser plate 86 disposed along the opening 502*c* is fixed to the mounting plate 501 with machine screws 86*b*, and packings 85 positioned on the presser plate 86 are fixed to the bottom 501*b* of the mounting plate 501 along the opening 501*c* of the mounting plate 501. Numeral 86*a* denotes an opening of the presser plate 80. When the opening 501 is sealed, the packings 85 are positioned around the openings 81*d* of the cylindrical body 81 and are in elastic contact with the cylindrical body. Although in the figure the packings 85 are positioned around the openings 81*d* of the cylindrical body 81 and are in elastic contact with the cylindrical body 81, the packings 85 may be formed almost equal to or a little larger than the openings 81*d* of the cylindrical body 81.

A gear 88 fixed onto one shaft portion 81*c* of the cylindrical body 81 is engaged with a gear 87 fixed onto an output shaft of a driving motor 82 and is controlled its rotation by the driving motor 82. The driving motor 82 is fixed to the upper waterproof cover 402 through a bracket BT. Microswitches 89 and 90 are attached to the bracket BT.

When an edge thickness measuring mode is selected, the cylindrical body 81 is rotated via the gears 86 and 87 by the motor 82 shown in FIG. 9(*a*) so that a shift is made from the state shown in FIG. 9(*b*) to the state shown in FIG. 9(*c*). This rotational position is controlled with the microswitches 89 and 90 by, for example, such positioning as utilizes head portions Sa and Sb of the machine screws S1 and S2 in the cylindrical body 81 as in FIG. 9(*c*).

The lens edge thickness measuring device 60 comprises a bracket 61 formed in such U-shape as shown in FIG. 7 and mounted on the carriage 15, a filler shaft 62 (measuring arm) which is held by the bracket 61 so as to be movable forward and backward relative to an upper surface of the left side portion of the grindstone 5, a rack 63 formed on the filler shaft 62, a pulse motor 64 fixed to the bracket 61, a pinion 65 fixed onto an output shaft 64*a* of the pulse motor 64 and engaged with the rack 63, a disc-like filler 66 integral with one end of the filler shaft 62, and a microswitch 67 positioned on the opposite end side of the filler shaft 62 and fixed onto the carriage 15.

When the filler 66 has retreated to a position deviated from the lens L, the microswitch 67 is pushed into ON by the opposite end of the filler shaft 62.

<Electric Section>

To an arithmetic and control circuit 100 (control means) in the electric section D are connected the motor 8 in the grinding section, the stepping motor 31, a drive controller 101 for controlling the operation of the pulse motors 18, 37, 47 and 64, a frame data memory 102, an FPD/PD input device 103 for inputting a frame PD value FPD and a wearer's a pupil-to-pupil distance value PD, a frame material input device 103 for inputting to the effect that the eyeglass frame concerned is a celluloid frame, a correction value memory 105 which stores a preset correction value C in accordance with the material of the frame, and a machining data memory 106 which stores machining data (Pi, Θi) for machining the lens L.

The FPF/PD input device 103 may be such a manual input device as a ten-key input device, or an on-line input device from an eye examining device, or a reader for reading data from an eye examination data storage means such as a floppy disc or an IC card.

When the drive controller 101 is operated by the arithmetic and control circuit 100 to generate a driving pulse from a pulse generator 107 and actuate the pulse motor 47, the rotary arm 48 is rotated. As a result, the filler 51 is moved along the inner periphery of a lens frame portion RF or LF of an eyeglass frame F.

At this time, the amount of movement of the filler 51 is detected by the encoder 52 and is inputted as a radial length fρi into the frame data memory 102 of the electric section D. Further, the same pulse as that fed to the pulse motor 47 from the pulse generator 107 is inputted as a rotational angle, ie., a radial angle f θi, to the frame data memory 102. Both such data are stored as radial data (fρi, fθi) of the lens frame (or template).

<Keyboard (Operating Panel Portion) 4>

Figure 10:
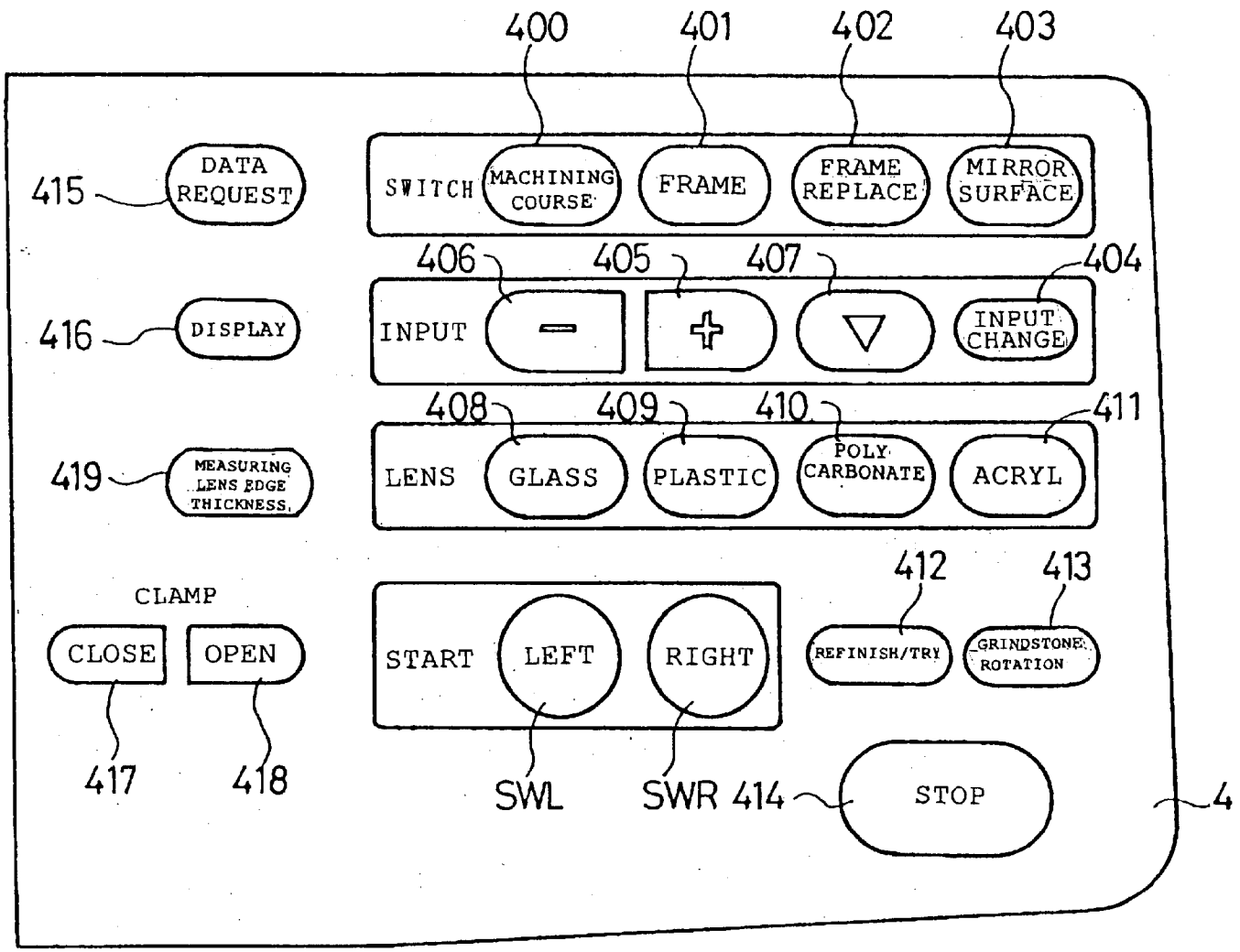
FIG. 10 is an enlarged explanatory view of a keyboard (operating panel) used in a lens edge thickness measuring device shown in FIG. 1.

On the operating panel portion, or the keyboard 4, as shown in FIG. 10, there are provided a machining course switch 400 which switches over between "AUTO" mode for grinding a lens peripheral edge and engravement-machining at the lens peripheral edge and "MONITOR" mode for manual operation, a "FRAME" mode switch 401 for selecting the material of an eyeglass frame, a "FRAME REPLACE" mode switch for machining to replace an old frame by a new frame while utilizing old lenses, and a "MIRROR SURFACE" mode switch 403 for mirror surface machining.

On the keyboard 4 are further provided an "INPUT CHANGE" mode switch 404 for pupil-to-pupil distance PD, geometric frame center-to-center distance FPD, and upward shift quantity "UP", a"+" input setting switch 405, a "−" input setting switch 406, a cursor key 407 for operating the movement of a cursor frame 407', a switch 409 for selecting a plastic material as the lens material, a switch 410 for selecting a polycarbonate as the lens material, and a switch 411 for selecting an acrylic resin as the lens material.

Further provided on the keyboard 4 are start switches such as a switch SWL for grinding the "LEFT" lens and a switch SWR for grinding the "RIGHT" lens, a "REFINISH/TRY" mode switch 412, a "GRINDSTONE ROTATION" switch 413, a stop switch 414, a data requesting switch 415, a display switch 416, switches 417 and 418 for opening and closing between a pair of lens rotating shafts in the machining section, and a lens thickness measurement starting switch 419.

The following description is now provided about the operation of the lens machining apparatus constituted as above.

(1) Measuring Eyeglass Lens Peripheral Shape

When a measurement start switch S shown in FIGS. 1 and 2 is pushed to operate the lens peripheral shape measuring section 46, the arithmetic and control circuit 100 measures the shape (lens peripheral shape) of the right- and left-eye lens frame portions RF, LF of the eyeglass frame F successively. Since the measurement of the lens frame portion RF and that of the lens frame portion LF are conducted in the same manner, the measurement of only the right-eye lens frame portion RF will be described below and that of the left-eye lens frame portion LF will be omitted.

Figure 11:
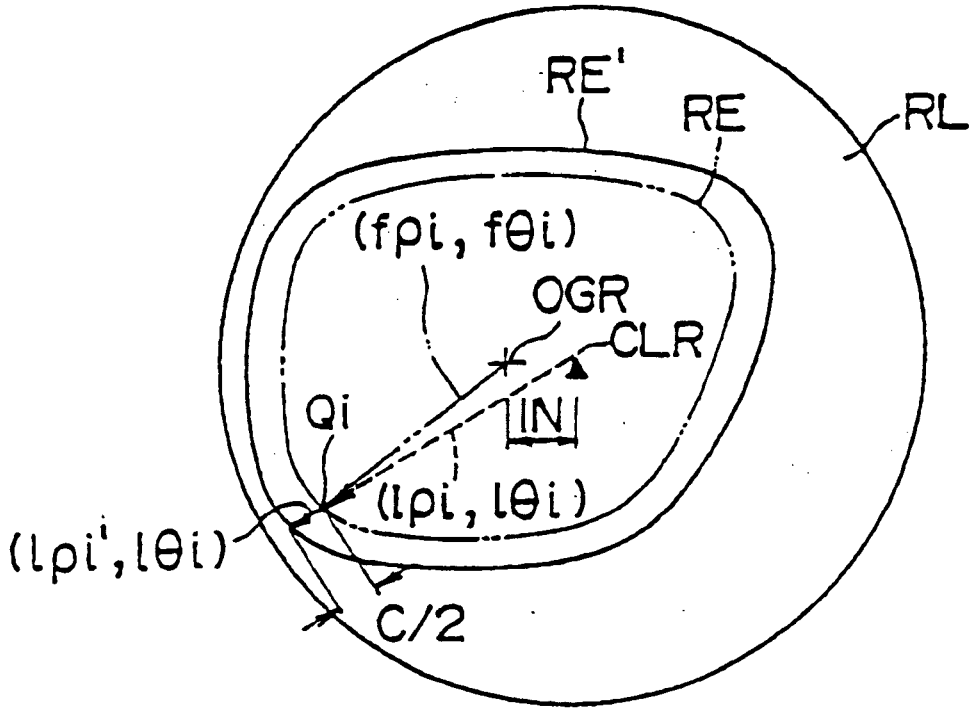
FIG. 11 is an explanatory view showing a relation between a lens to be machined and a lens frame shape both illustrated in FIG. 2.
Figure 12:
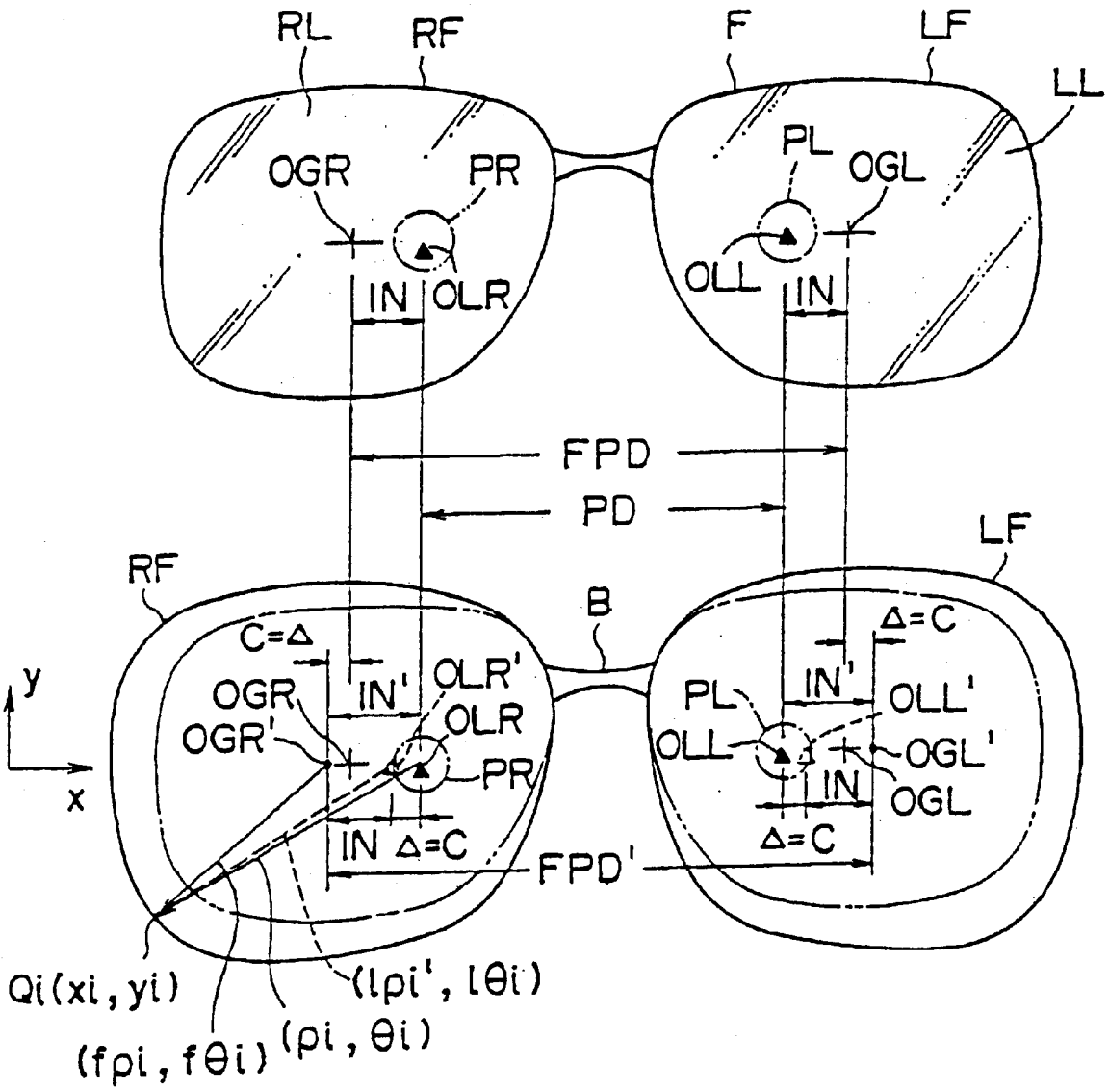
FIG. 12 is an explanatory view showing inward shift quantity and upward shift quantity from a geometrical center of the lens frame illustrated in FIG. 2.

First, the arithmetic and control circuit 100 measures the shape of lens peripheral such as the right-eye lens frame portion RF or template of the eyeglass frame F like that shown in FIGS. 11 and 12 to obtain radial data (fρi, fθi) (i=1, 2, 3, . . . N) thereof and stores the data in the frame data memory 102.

In the case where the eyeglass frame F is a celluloid frame, the worker inputs that to the arithmetic and control circuit 100 by means of the frame material input device 104.

The worker also inputs frame PD value FPD and wearer's pupil-to-pupil distance value PD to the arithmetic and control circuit 100 by means of the FPD/PD input device 106. In accordance with the inputted frame PD value FPD, pupil-to-pupil distance value PD and correction value C stored in the correction value memory 105, the arithmetic and control unit 100 determines a correctional inward shift quantity IN' taking into account a deviation of an optical center OLR of the right-hand lens caused by deformation of the eyeglass frame after fitting the lens in the frame, as follows:

$$IN'=\{(FPD-PD)/2\}-C/2 \quad (1)$$

Then, with respect to each sampling point Qi of the lens frame (or template) radial date (fρi, fθi) stored in the frame data memory 102 and having an origin at a geometrical center of the lens frame RF, the arithmetic and control unit 100 makes an x-y coordinate transformation of the radial data to obtain:

$$xi=f\rho i\cdot\cos(f\theta i)$$
$$yi=f\rho i\cdot\sin(f\theta i) \quad (2)$$

then, the arithmetic and control circuit 100 causes the x coordinate value to shift in the x-axis direction (horizontal direction) by the correctional inward shift quantity IN' to obtain machining data (Pi, Θi) based on the new origin as follows:

$$Pi=\{(xi+IN')2+yi2\})/2$$
$$\theta i=\tan-1\{yi/(xi+IN')\} \quad (3)$$
$$(i=1, 2, 3, \ldots N)$$

and the arithmetic and control circuit 100 causes this data to be stored in the machining date memory 102.

The correction value C is set at a value of 0.3 to 0.5 mm in the case where the material of the eyeglass frame F is a commonly-used material such as acetate, acryl, nylon, or propionate, while in case of a highly thermoplastic material such as an epoxy resin, it is set at a value of 0.8 to 1.0 mm. To cope with such plural types of celluloid frames, a plurality of input keys are provided in the frame material input device 107 and a plurality of correction values C are stored in the correction value memory 105 correspondingly to various frame material inputs.

(2) Measuring Lens Edge Thickness Wi

Next, the edge thickness Wi of the lens L to be machined is determined on the basis of the machining data (Pi, Θi) corresponding to the radial data (fρi, fθi).

More specifically, when the operation mode is set to the edge thickness measuring mode by operating the keyboard portion 4, the arithmetic and control circuit 100 controls the operation of the pulse motor 18 via the drive controller 101, causes the rotation of the pulse motor 18 to be transmitted to the lens shafts 16 and 17 via the power transfer mechanism 19, and causes initial machining data (P1, Θ1) contained in the machining data (Pi, Θi) on the lens L to be shifted to the position of abutment with the filler 66.

Before moving the filler 66 to the position of abutment with the lens L, there is made an adjustment so that the window portions of the cylindrical body 81 in the edge thickness measuring device opening/closing unit 80 located between the edge thickness measuring means 60 and the machining chamber are opened when the edge thickness measuring mode is set.

Once the edge thickness measuring mode is set, the cylindrical body 81 is rotated via gears 88 and 87 by the motor 82 shown in FIG. 9(*a*), thereby making a shift from the state shown in FIG. 9(*b*) to the state shown in FIG. 9(*c*). This rotational position is controlled with the microswitches 89 and 90 by, for example, such positioning as utilizes the head portions Sa (Sb) of the machine screws S1 and (S2) in the cylindrical body 81, as shown in FIG. 9(*d*).

After the state shown in FIG. 9(*c*) has been reached, the feeler 66 is allowed to enter the machining chamber BA to measure the lens L to be machined.

As the machining is performed, the grinding water or chips may adhere to the cylindrical body 81. If the grinding water or chips adhere to the opening/closing windows of the filler 66 and if there is used the conventional method of opening and closing a flat plate, the adhered grinding water or fluid will be solidified between the flat plate and a fixed base 402, resulting in the flat plate being unable to be opened or closed, or the grinding water or fluid adhered at the time of opening or closing may enter the filler measuring portion and cause a failure.

In FIG. 9(*a*), in effecting the opening or closing operation, the cylindrical body 81 is rotated while the packings 85 are brought into contact with the outer peripheral portion of the cylinder to take off the deposition on the cylindrical body, so that the grinding water or fluid no longer gets into the filler measuring portion. The packings 85 also fulfills a waterproofing function between the cylindrical body 81 and the machining chamber BA.

Moreover, all that is required is merely rotating the cylindrical body as compared with opening and closing a flat plate in the prior art. Thus, the mechanism used is simple and compact.

Further, the keyboard portion 4 is operated, causing the stepping motor 31 to be operated by the arithmetic and control circuit 100, thereby causing the carriage 15 to move leftwards in FIG. 7. At this time, the amount of movement of the carriage 15 is inputted to the arithmetic and control circuit 100.

Thereafter, the drive controller 101 is operated by the arithmetic and control circuit 100 to controlled the operation of the pulse motor 64, causing the filler shaft 62 to move above the grindstone 5 via the pinion 65*a* and the rack 63 and causing the filler 66 on the filler shaft 62 to move sideways of the lens L.

As the filler shaft 62 moves, it goes away from the microswitch 67, and upon turning OFF of the microswitch 67, this OFF signal is inputted to the arithmetic and control circuit 100, which in turn detects the amount of movement of the filler shaft 62 from when the microswitch has thus turned OFF on the basis of the number of driving pulses fed to the pulse motor 64. Besides, the filler 66 is moved up to the portion corresponding to the initial machining data (P1, Θ1) included in the machining data (Pi, Θi) on the lens L.

In this state, if the supply of electric power to the stepping motor 31 is stopped, allowing the stepping motor to rotate freely, the carriage 15 and the support arm 26 are moved rightwards in FIGS. 4(*a*) and 4(*b*) by virtue of resilience, so that a right-hand refractive face of the lens L held between the lens rotating shafts 16 and 17 comes into abutment against the filler 66. This abutment position corresponds to the position of the initial machining data (P1, Θ1) on the lens L.

The arithmetic and control circuit 100 controls the operation of the pulse motors 18 and 64 from the initial abutment position of the filler 66, causing the abutment position of the filler 66 to shift successively on the basis of the machining date (Pi, Θi)[i=1, 2, 3, . . . N]. At this time, in accordance with the output from the rotary encoder 34 the amount of movement of the carriage 15 is made corresponding to the machining data (Pi, Θi) and stored in the machining data memory 106.

Likewise, by operating the keyboard portion 4, the stepping motor 31 is operated by the arithmetic and control circuit 100, causing the carriage 15 to move rightwards in FIG. 7, then the filler 66 is brought into abutment against a left-hand refractive face of the lens L, the abutment position of the filler 66 is shifted successively on the basis of the machining data (Pi, Θi)[i =1, 2,3, . . . N], the amount of movement of the carriage 15 corresponding to the machining data(Pi, Θi) is determined by the arithmetic and control circuit 100, the amount of movement thus determined is made corresponding to the machining data (Pi, Θi) and stored in the machining data memory 106.

Then, on the basis of the amount of movement of the carriage 15 thus determined the arithmetic and control circuit 100 determines the positions of abutment of the filler 66 against the right and left refractive faces of the lens L correspondingly to the machining data (Pi, Θi), and then on the basis of the abutment positions thus determined the arithmetic and control circuit 100 determines the edge thickness Wi of the lens L correspondingly to the machining data (Pi, Θi).

Figure 13:
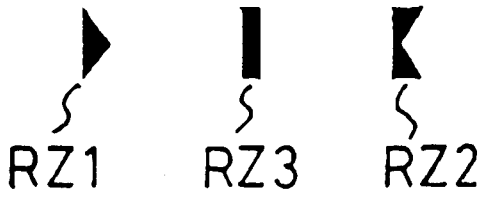
FIG. 13 is an explanatory view of graphic symbols for the distinction of lenses.

At the same time, on the basis of the measurement result thus obtained the arithmetic and control circuit 100 judges whether the lens to be machined is a plus lens, a flat lens, or a minus lens. When the lens L is rotated and the edge thickness is measured along lens peripheral shape, the lens, if it is a convex lens, becomes thicker toward the center from the peripheral edge, while in case of a minus lens, it becomes thinner toward the center, further, in case of a flat lens, its thickness scarcely changes between its peripheral portion and its central portion. Thus, the type of a lens can be judged on the basis of the edge thickness. In this way the arithmetic and control circuit 100 classifies lenses into groups according to their types and stores the thus-classified groups into memory. In this embodiment lenses are classified into three groups. As shown schematically in FIG. 13, plus, minus, and flat lenses are indicated by graphic symbols RZ1, RZ2, and RZ3, respectively.

(3) Lens Grinding (a) Grinding Right-hand Lens RL (one lens)

Figure 22:
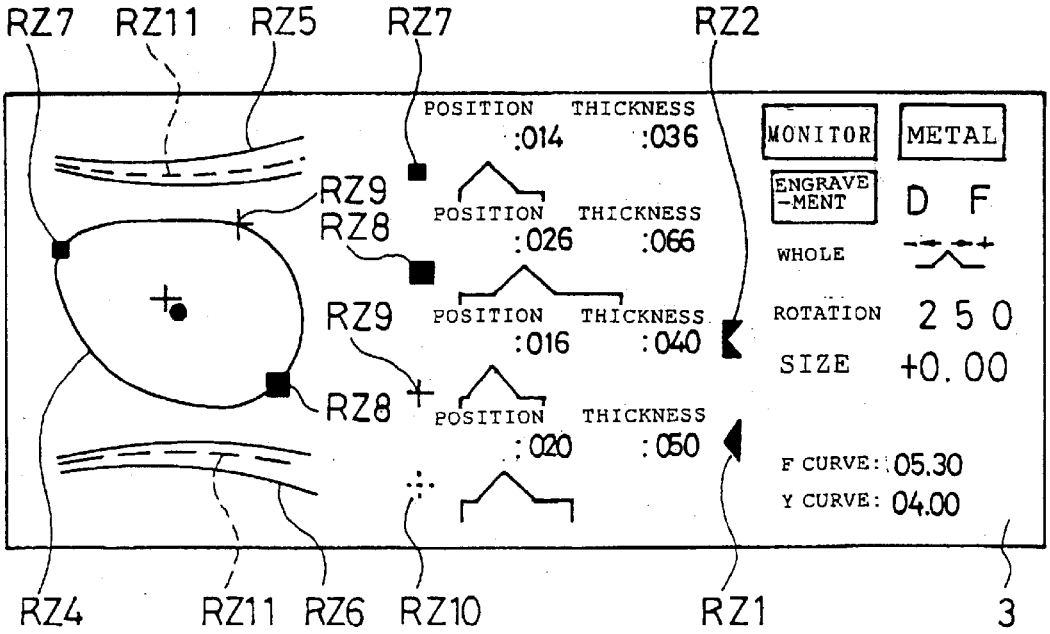
FIG. 22 is a diagram for explaining the adjustment of engravement curve in accordance with engravement information shown in FIG. 20.
Figure 23:
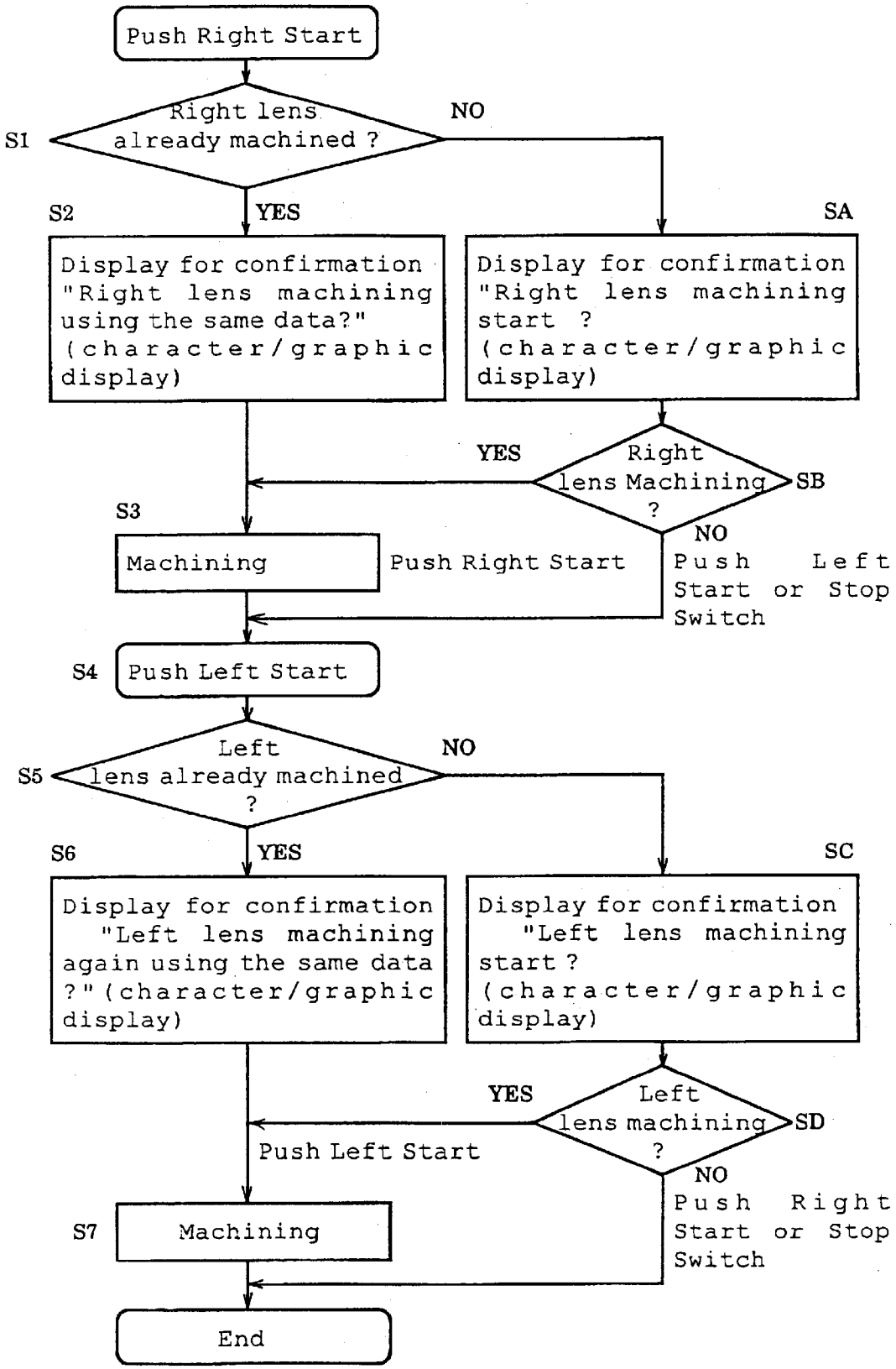
FIG. 23 is a flow chart for explaining an entire operation control in the apparatus according to the invention.
Figure 24:
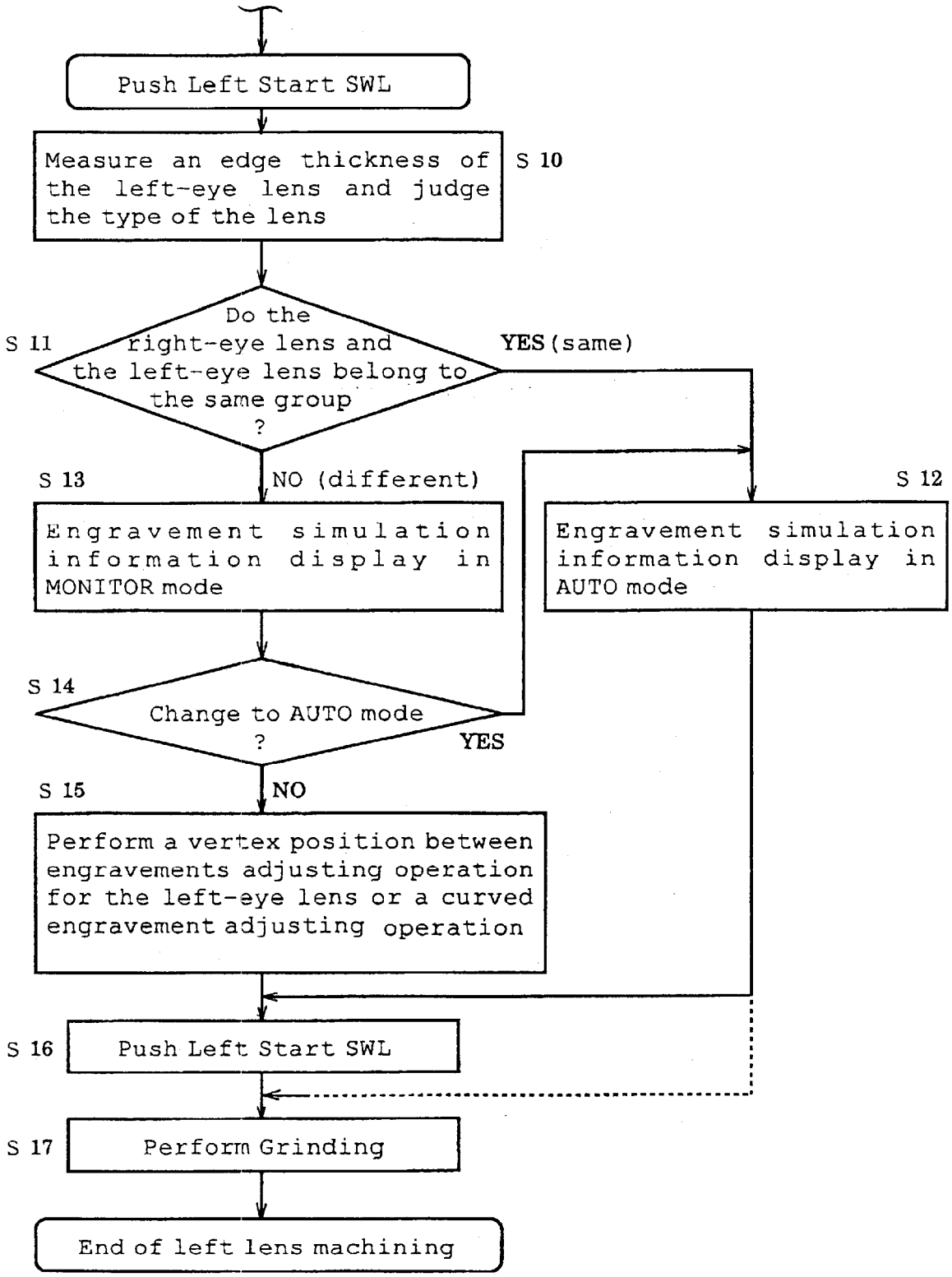
FIG. 24 is a flow chart for explaining an engravement information adjusting operation related to the invention.

In the case where grinding of the right- and left-eye lenses (RL, LL) is to be controlled continuously by the arithmetic and control circuit 100 and where it is preset so as to grind the right-eye lens RL (eyeglass lens for the right eye) first, there are performed such operations as displayed in FIGS. 14 to 22 and as shown in FIGS. 23 and 24.

Step S1

Once the machining data (Pi, Θi) are obtained as above, the arithmetic and control circuit 100 store the thus-obtained machining data (Pi, Θi) into the machining data memory 102.

When the right-eye lens RL machining start switch SWR (machining start switch) shown in FIG. 10 is pushed, it is judged in step s1 whether the right-eye lens RL has already been subjected to machining, and if the answer is affirmative, the flow shifts to step S2, while if the answer is negative, the flow shifts to step SA.

Step SA

Figure 14:
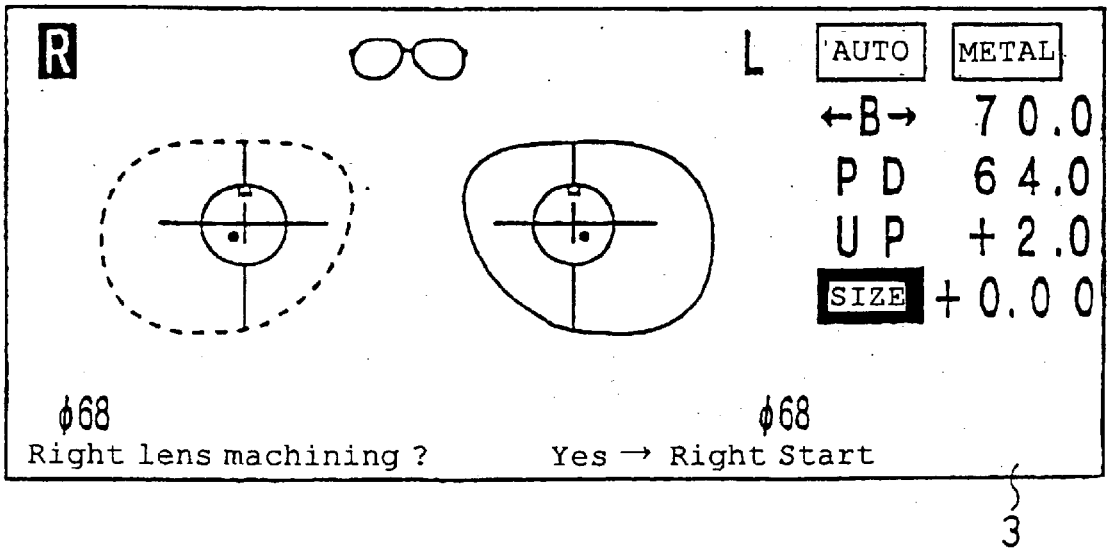
FIG. 14 is an explanatory view of a display in a right-hand lens machining operation.

In this step, a display for conformation such as a character display like "Right lens machining?" and "Yes→Right Start", or "Right lens machining start?", is given at lower positions of the liquid crystal display portion 3 as in FIG. 14, thereby calling the worker's attention, and the flow shifts to step SB.

Step SB

In this step it is judged whether the left-hand lens machining start switch SWL (or a stop switch STP) has been pushed or whether the right-hand lens machining start switch SWR has been pushed, and if the left start switch SWL (or the stop switch STP) has been pushed, the flow shifts to step S4, while if the right start switch SWR has been pushed, the flow shifts to step S3.

Step S2

Figure 15:
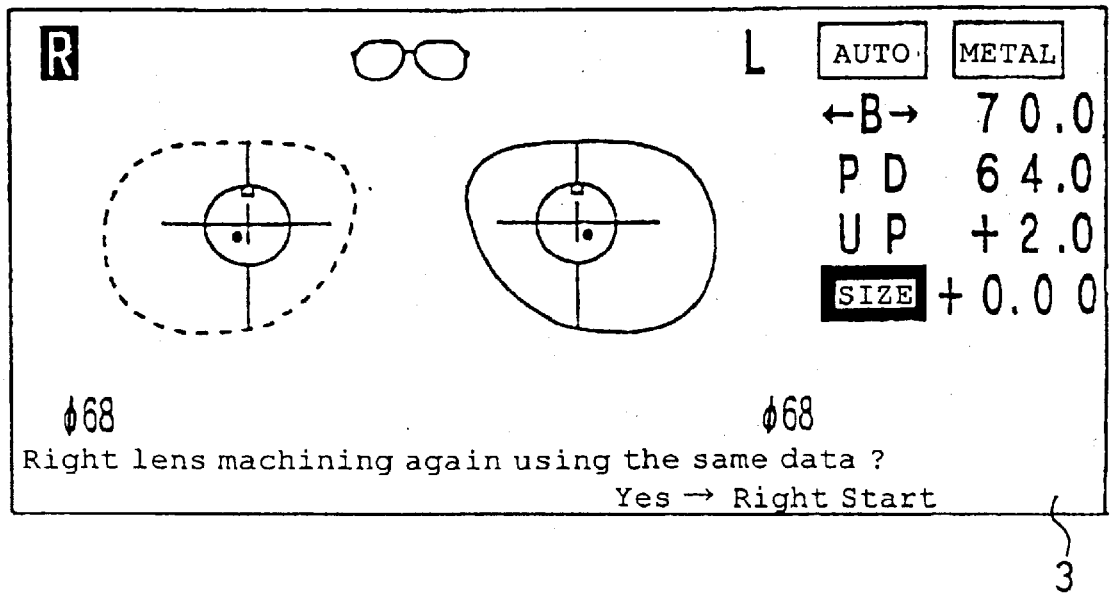
FIG. 15 is an explanatory view of a display in a subsequent right-hand lens machining operation.

In this step, a display for confirmation such as a character display like "Right lens matchining again using the same data?" and "Yes→Right Start" is given on the liquid crystal display portion 3 as in FIG. 15, thereby calling the worker's attention, and the flow shifts to step S3.

Step S3

In this step, the arithmetic and control circuit 100 controls the drive controller 101 to drive the motor 8, thereby rotating the grindstone 5 to start grinding for the right-hand lens RL.

Then, under the control of the arithmetic and control circuit 100 and in accordance with the machining data (Pi, Θi) stored in the machining data memory 106, the drive controller 101 makes control to supply a pulse for rotating the lens rotating shafts 16 and 17 by angle of θi to the pulse motor 18 from the pulse generator 107, and for stopping the descent of the carriage 15 at a position where the machining radius at the angle of θi is Pi, the drive controller 101 makes control to supply the pulse motor 37 with pulses for stopping the swing arm 300.

As a result, the lens rotating shafts 16 and 17 are rotated by the machining radial angle θi. On the other hand, the lens RL is subjected to grinding by the grindstone 6 while being in pressure contact with the grindstone by virtue of the own weight of the carriage 15, and as the grinding proceeds, the carriage 15 is brought down by its own weight. This descent of the carriage 15 continues until the swing arm 300 rises into abutment against the urging member 40 and the machining radius of the lens RL become Pi.

In this case, if the pressure at which the lens RL is brought into pressure contact with the grindstone 6 by the own weight of the carriage 15 is assumed to be a machining pressure, this machining pressure is adjusted by the arithmetic and control circuit 100 in accordance with the edge thickness Wi of the lens RL. To be more specific, the arithmetic and control circuit 100 increases the machining pressure as the edge thickness Wi of the lens RL becomes larger, while it decreases the machining pressure as the edge thickness Wi of the lens RL becomes smaller. The machining pressure can be determined as a downward rotational moment Fi of the carriage 15 in the following manner.

Given that a downward rotational moment of the carriage 15 based on the own weight of the carriage if f1, a downward rotational moment of the swing arm 300 is f2, a downward rotational moment of the machining pressure adjusting means 310 exclusive of the weight 316 is f3, and a downward rotational moment based on the weight 316 is fai (f1>f2+f3+fai), a rotational moment Fi for actually rotating the carriage 15 downward is:

$$Fi=f1-(f2+f3+fai)$$

Further, if the weight 316 weighs Wg and the distance from the center of the support shaft 12 to the center of gravity of the weight 316 is Bi, the downward rotational moment fai of the weight 316 is:

$$fai=Wg\times Bi$$

The distance Bi can be varied by moving the weight 316 in the longitudinal direction. The longitudinal movement of the weight 316 is controlled by the arithmetic and control circuit 100.

As the edge thickness Wi of the lens RL becomes larger, the arithmetic and control circuit 100 controls the pulse motor 320 so as to rotate forward, thereby causing the feed screw 318 to rotate forward and causing the weight 316 to move forward. On the other hand, as the edge thickness Wi of the lens RL becomes smaller, the arithmetic and control circuit 100 controls the pulse motor 320 so as to rotate reverse, thereby causing the feed screw to rotate reverse and causing the weight 316 to move backward.

With the forward movement of the weight 316, the rotational moment fai becomes smaller and the downward rotational moment Fi (machining pressure) of the carriage 15 becomes larger, while with the backward movement of the weight 316, the rotational moment fai becomes larger and the downward rotational moment Fi (machining pressure) of the carrige 15 becomes smaller.

Consequently, the machining pressure increases with an increase in the edge thickness Wi of the lens RL and decreases with a decreases of the edge thickness Wi. Accordingly, when a lens having a large edge thickness is subjected to grinding with the rough grindstone 6, it is possible to prevent the grindstone 6 from slipping relative to the lens, and when the edge thickness of a lens to be machined is small, it is possible to prevent an excessive machining pressure from being exerted on the lens from the grindstone 6. Thus, the machining pressure for the lens to be machined is adjusted automatically in accordance with the edge thickness Wi of the lens, so that the grinding work can be done efficiently without requiring much labor. It is also possible to make control so that the machining pressure can be controlled according to the type of a lens to be machined. By providing a memory in the arithmetic and control circuit for the storage of data regarding to what degree the machining pressure is to be adjusted according to the type of a lens and by reading the data from the memory it is possible to adjust the machining pressure. For example, a machining pressure of 3.5 kg is stored in the memory in case of a plastic lens and a machining pressure of 5.0 kg is stored in the memory in case of a glass lens. Then, by reading the stored data from the memory, the arithmetic and control circuit 100 controls the machining pressure adjusting means 310.

By performing this operation for all of the machining data (Pi, Θi) the lens L is subjected to rough machining on the basis of the machining data into a lens RL of a shape similar to the shape of the lens frame portion RF.

When the rough grinding with the grindstone 6 is completed, the lens RL is moved by a known carriage moving means (not shown) and is subjected to engravement-machining with the V-groove grindstone 7. In this case, the arithmetic and control circuit 100 makes control so that the peripheral edge of the lens L is subjected to engravement-machining on the basis of the edge thickness corresponding to the machining data (Pi, Θi) obtained in the foregoing measurement (2). When the grinding for the right-eye lens RL is completed, the arithmetic and control circuit 100 controls the drive controller 101 to turn off the motor 8, thereby stopping the rotation of the grindstone 5. The lens RL is chucked by the lens rotating shafts 16 and 17 so that its optical center OLR is aligned with the rotational axis of the shafts 16 and 17.

Then, upon completion of grinding for the right-eye lens RL in step S3, the operation is stopped and the flow shifts to step S4.

Step S4

In the case where the left start switch SWL is pushed in step SB and the flow has shifted to this step S4, the flow shifts to step S5. Where the stop STP is pushed in step SB, followed by shift to this step S4, and also where the flow has shifted to this step S4 from step S3, a stand-by state continues until depression of the switch SWR or SWL. When either the switch SWR or the switch SWL is depressed, the flow shifts to step S5.

Step S5

In step S5 it is judged whether the grinding for the left-eye lens LL has been completed or not. If the answer is affirmative, the flow shifts to step S6, while if the answer is negative, the flow shifts to step SC.

Step SC

Figure 16:
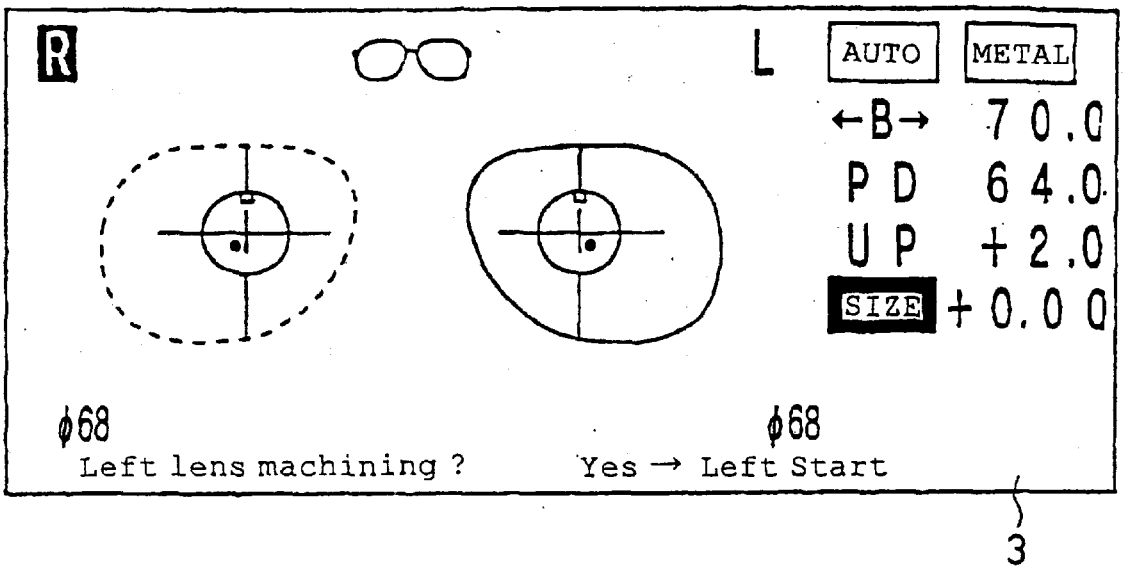
FIG. 16 is an explanatory view of a display in a left-hand lens machining operation.

In this step, a display for confirmation using a character display such as "Left lens machining?" and "Yes→Left Start" or a character display such as "Left lens machining start?" like those shown in FIG. 16 is given at lower positions of the liquid crystal display portion 3, thereby calling the worker's attention, and the flow shifts to step SD.

Step SD

In this step it is judged whether the right start switch SWR (or the stop switch STP) has been pushed or whether the left start switch SWL has been pushed, and if the right start switch SWR (or the stop switch STP) has been pushed, the machining is terminated, while if the left start switch SWL has been pushed, the flow shifts to step S7.

Step S6

Figure 17:
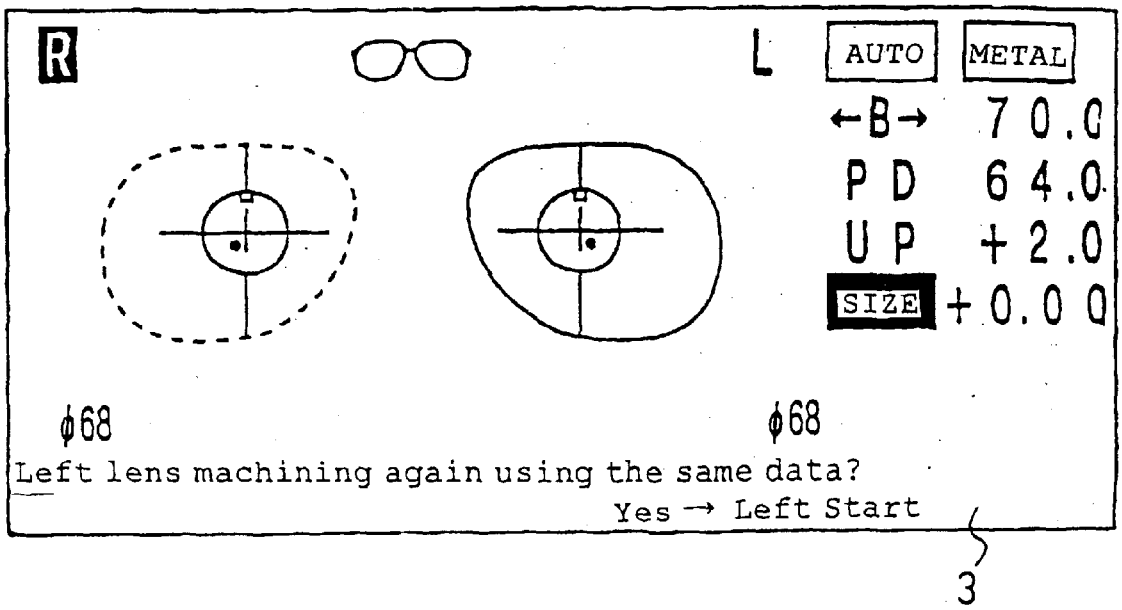
FIG. 17 is an explanatory view of a display in a subsequent left-hand lens machining operation.

In this step, as shown in FIG. 17, a display for confirmation using a character display such as "Left lens machining again using the same data" and "Yes→Left Start" is given in the liquid crystal display portion 3, as shown in FIG. 17, thereby calling the worker's attention, and the flow shifts to step S7.

Step S7

Figure 18:
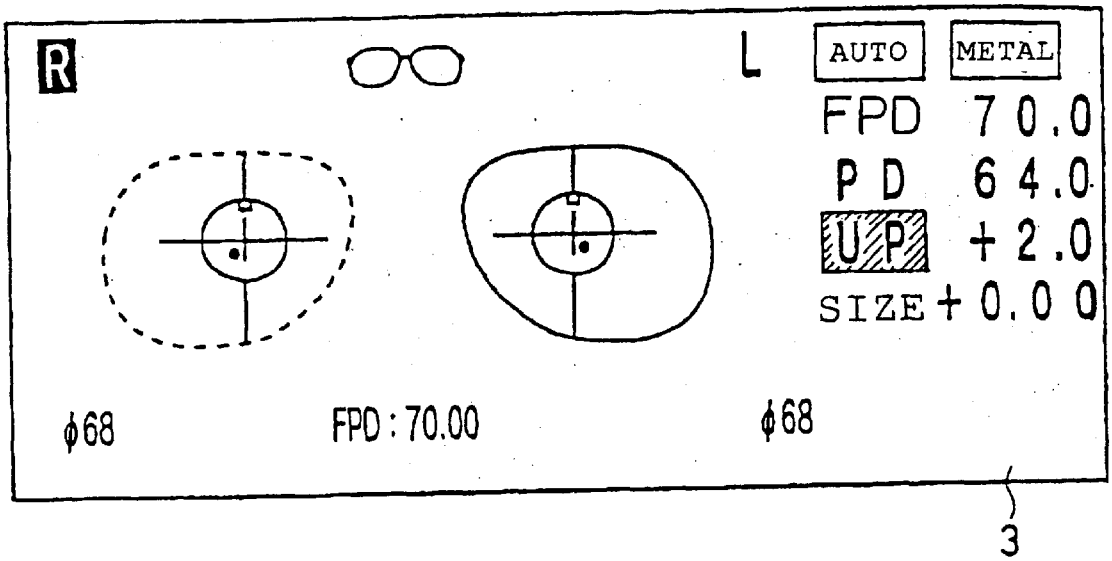
FIG. 18 is an explanatory view of a display at the start of machining the left-hand lens after completion of the right-hand lens machining.

In this step, when the right-hand lens grinding has been completed via steps S1, SA, SB and S3 and the flow has reached step SD via steps S4, S5 and SC, a lens peripheral shape curve corresponding to the unmachined lens for the left-hand eye which lens is to be machined, is displayed with a solid line in the display portion 3, while a lens peripheral shape curve corresponding to the machined lens for the right-hand eye is displayed with a broken line, as shown in FIG. 18.

On the right-hand side of the liquid crystal display portion 3 are display auto, monitor switch-over display, frame-to-frame PD (FPD), pupil-to-pupil distance, upward shift quantity UP, and Size. In FIG. 18, the black circular mark "•" represents an optical center of an eyeglass lens, while the cross point represents a geometrical center of the eyeglass frame.

When the left start switch SWL is pushed, the edge thickness measurement for the left-eye lens is started (step S10 in FIG. 24). This edge thickness measurement is conducted by the same procedure as that for the right-eye lens, so a detailed explanation thereof is here omitted.

On the basis of the result of the edge thickness measurement the arithmetic and control circuit 100 judges to which of the plus lens RZ1, flat lens RZ3, and minus lens RZ2 groups the left-eye lens belongs, and makes a comparison as to whether the group to which right-eye lens belongs and the group to which the left-eye lens belongs are the same or not (step S11).

Where the group to which the right-eye lens belongs and the group to which the left-eye belongs are the same, the arithmetic and control circuit 100 shifts the flow to an engravement simulation display while maintaining the operation mode in the auto mode (S12), in which engravement information is displayed on the liquid crystal display portion 3. On the left-hand side of the display the reference mark RZ4 represents a lens peripheral shape curve with an unmachined lens L as seen from the front, the mark RZ5 represents a lens shape curve with the unmachined lens L as seen from above, and the mark RZ6 represents a lens shape curve with the unmachined lens L as seen from below.

The "•" present inside the lens peripherial shape curve RZ4 represents an optical center and the "+" mark represents a geometrical center of the frame. A small black mark "■" represents a minimum edge thickness position pattern RZ7, a large black mark "■" represents a maximum edge thickness position pattern RZ8, and "+" mark represents an arbitrary circumferential edge thickness position pattern RZ9.

Centrally of the liquid crystal display portion 3 are displayed the minimum edge thickness position pattern RZ7, the maximum edge thickness position pattern RZ8, and the arbitrary circumferential edge thickness position pattern RZ9 successively from above. Below the arbitrary circumferential edge thickness position pattern RZ9 is displayed an arbitrary circumferential edge thickness position pattern RZ10 of the right-eye lens after machining, using a broken line. The pattern RZ10 is in one-to-one corresponding to the display position of the arbitrary circumferential edge thickness position pattern RZ9 of the unmachined lens on the lens peripheral shape curve RZ7.

On the right-hand side of the minimum edge thickness position pattern RZ7 are displayed a character and numerical value of vertex "position" between engravements at the minimum edge thickness position, and further on the right-hand side thereof are displayed a character and numerical value of "thickness". For example, it is displayed that a vertex position between engravements at the minimum edge thickness position lies at 0.014 from the front end of the lens on the edge face and that the minimum edge thickness is 0.036. Below those characters and numeral values is graphically displayed a sectional shape of engravement at the minimum edge thickness position.

Likewise, on the right-hand side of the maximum edge thickness position pattern RZ8 are displayed a character and numerical value of a vertex "position" between engravements at the maximum edge thickness position and further on the right-hand side thereof are displayed a character and numerical value of "thickness". Below those characters and numerical values is graphically displayed a sectional shape of engravement at the maximum edge thickness position.

Likewise, on the right-hand side of the arbitrary circumferential edge thickness position pattern RZ9 are displayed a character and numerical value of a vertex "position"

between engravements at the arbitrary edge thickness position and further on the right-hand side thereof are displayed a character and numerical value of "thickness". Below those characters and numerical values is displayed graphically a sectional shape of engravement at the arbitrary circumferential edge thickness position.

On the right-hand side of the arbitrary circumferential edge thickness direction pattern RZ10 of the right-eye lens after machining are displayed a character and numerical value of a vertex "position" between engravements at the arbitrary circumferential edge thickness position of the machined lens, and further on the right-hand side thereof are displayed a character and numerical value of "thickness". Below those characters and numerical values is displayed graphically a sectional shape of engravement at the arbitrary circumferential edge thickness position of the right-eye lens.

By seeing the engravement information displayed on the liquid crystal display portion 3 the worker can estimate, before machining, the minimum edge thickness, maximum edge thickness, edge thickness at the arbitrary circumferential position, and engravement shapes at those positions, which will be attained after machining.

On the right-hand side of the liquid crystal display portion 3 are displayed characters "AUTO, METAL, ENGRAVEMENT, WHOLE, ROTATION, SIZE, F CURVE, Y CURVE". Since the operation mode is here an auto mode, AUTO is displayed whitely on a black base. The numerical value described on the right-hand side of "ROTATION" means that the designated arbitrary circumferential edge thickness position patter RZ9 is at the position of 250° from the reference position. Likewise, the numerical values described on the right-hand side of F CURVE and Y CURVE mean a frame curve and an engravement curve (a vertex path between engravements), respectively. This engravement curve is graphically displayed with a broken line RZ11 on the left-hand side of the liquid display portion 3.

The machined arbitrary circumferential edge thickness position pattern RZ10 means that it lies in the position of 250° from the reference position on the lens peripheral shape curve for the right-hand eye.

Figure 19:
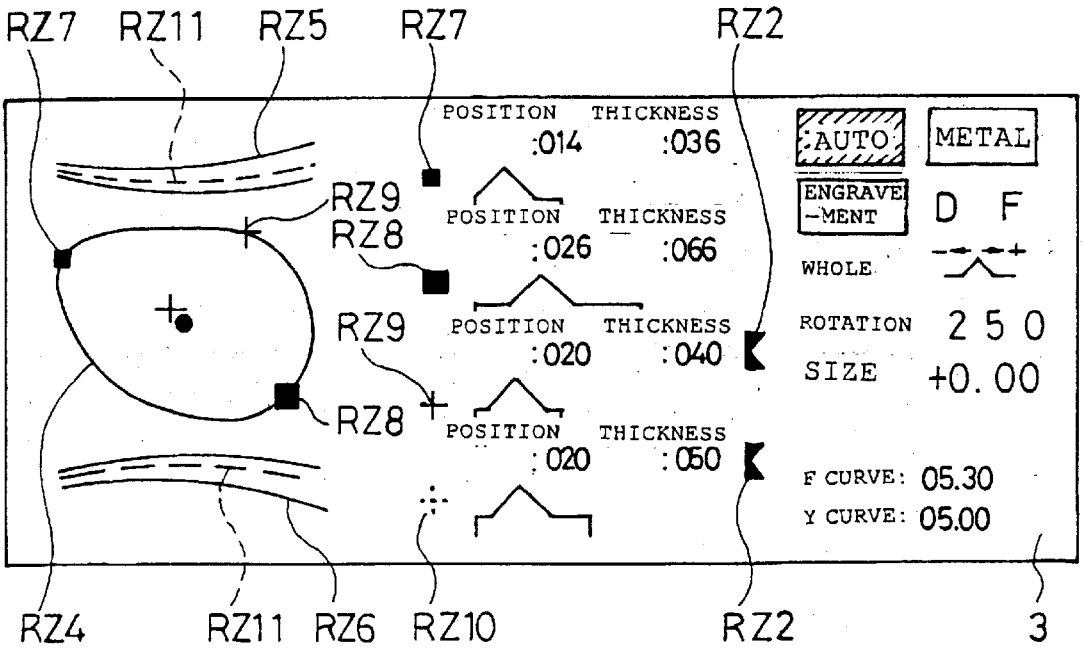
FIG. 19 is an explanatory view of a display in the case where both right- and left-eye lenses belong to the same group.

On the liquid crystal display portion 3 are further displayed the group to which the machined right-eye lens belongs and the group to which the unmachined left-eye lens belongs. In FIG. 19, the group to which the machined lens belongs and the group to which the unmachined lens belongs are the same, and a graphic symbol is displayed indicating that both lenses are minus lenses RZ2.

When the left start switch SWL is pushed (S16), the arithmetic and control circuit 100 controls the drive controller 101 to operate the motor 8, thereby causing the grindstone 5 to rotate, so that the grinding for the left-eye lens is carried out (S17) and is completed. As indicated with a broken line in FIG. 24, the grinding work may be carried out automatically without pushing the left start switch SWL.

Figure 20:
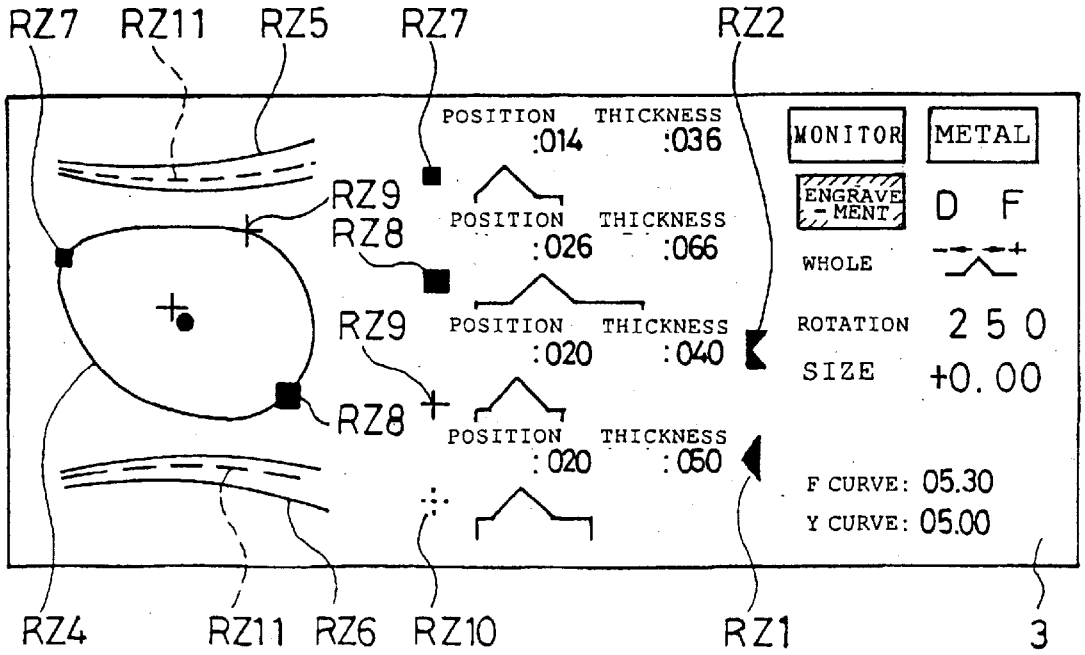
FIG. 20 is an explanatory view of a display in the case where right- and left-eye lenses belong to different groups.
Figure 21:
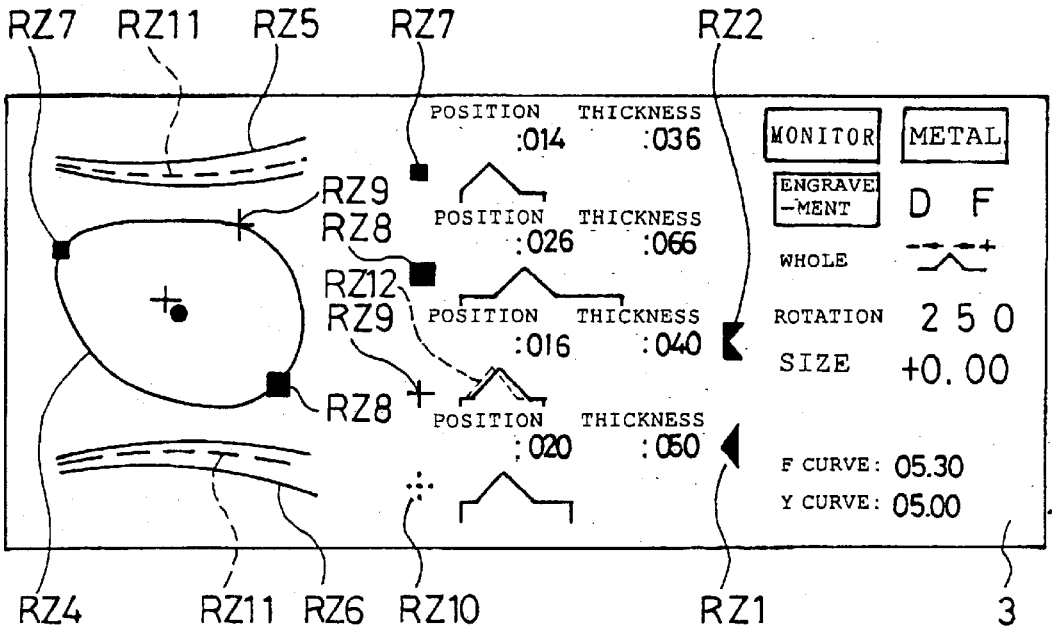
FIG. 21 is a diagram for explaining the adjustment of engravement position in accordance with engravement information shown in FIG. 20.

If in step S11 the group to which the machined eyeglass lens belongs and the group to which the unmachined eyeglass lens belongs are different, the flow shifts to an engravement simulation display in the monitor mode (S13), which display is shown in FIG. 20. Then, the flow shifts to step S14, in which an inquiry is made as to whether a shift to the auto mode is to be made or not. Where the adjustment of engravement information is not necessary, a shift is made to the engravement simulation display in the auto mode (S12), in which machining is carried out in the auto mode. If the monitor mode is not changed, engravement information is adjusted while looking at the display shown in FIG. 20 (S14). The inquiry as to whether a shift is to be made to the auto mode or not (S14) may be omitted.

In FIG. 20 it is displayed by a graphic symbol with mark RZ1 affixed thereto that the group to which the machined eyeglass lens belongs is a plus lens group and further displayed by a graphic symbol with mark RZ2 affixed thereto that the group to which the unmachined lens belongs is a minus lens group. With these displays the worker can recognize that the machined lens group and the unmachined lens group are different.

Next, the cursor key 407 is operated to shift the cursor to the position of engravement (S15), with consequent display of the character "engravement" whitely on a black base. Next, while looking the engravement sectional shape patterns and numerical values displayed on the liquid crystal display portion 3, the worker makes comparison between the vertex position between engravements of the machined lens and that of unmachined lens. Then, if the cursor key 407 is operated to set the cursor at the position of "WHOLE" on the display and, after operating the input changing switch 404, if the "+" switch engravement information adjusting means 405 is operated, engravement moves from the front end toward the rear end, while if the "−" switch engravement information adjusting means 406 is operated, engravement moves from the rear end toward the front end, whereby the vertex position between engravements of the unmachined lens at the arbitrary circumferential edge thickness position is adjusted. In the same figure, the broken line indicated by mark RZ12 represents a sectional shape of engravement after the adjustment and the numerical value represents a vertex position between engravements.

Next, if the cursor key 407 is operated to set the cursor at the position of "ROTATION" and, after operating the input changing switch 404, if the "30 " switch 405 or the "−" switch 406 is operated, the display position of the arbitrary circumferential edge thickness postion pattern "+" on the lens peripheral shape curve RZ4 shifts clockwise or counterclockwise. At the same time, the sectional shape of engravement at the arbitrary circumferential edge thickness position designated by the arbitrary circumferential edge thickness position pattern "+", as well as the numerical value which represents the vertex position between engravements referenced to the lens front end and the numerical value which represents the edge thickness, are displayed as engravement information. Further, engravement information of the machined eyeglass lens at the position corresponding to the arbitrary circumferential edge thickness position of the unmachined eyeglass lens is displayed. By repeating this operation as desired it is possible to adjust the engravement information so that both right- and left-eye lenses when fitted in an eyeglass fram protrude uniformly from the front side of the frame.

Next, if the left start switch SWL is pushed, grinding is carried out (S16 and S17).

According to the present invention, in machining the peripheral edge of one eyeglass lens (for the right eye) on the basis of one lens peripheral shape and thereafter machining the peripheral edge of the other eyeglass lens (for the left eye) on the basis of the other lens peripheral shape, it is possible to recognize to which of plus lens, flat lens and minus lens (including special lenses such as progressive multi-focus lenses) groups the right- and left-eye lenses belong respectively and then execute engravement-grinding in accordance with the thus-adjusted engravement information. Therefore, even when right- and left-eye lenses are of different degrees, the lenses can be fitted into the eyeglass frame tastefully.

FIG. 22 is an explanatory diagram of engravement simulation according to another embodiment of the present invention, showing an example of adjusting Y curve (engravement curve).

The Y curve can be adjusted by operating the cursor switch 407 to set the cursor at the position of Y curve, then operating the input changing switch 404 and further operating the plus switch 405 or the minus switch 406 to change the associated numerical value.

FIG. 22 shows a state in which the numerical value "0.500" shown in FIG. 20 has been changed to "0.400".

Also by this adjustment of Y curve it is possible to adjust engravement information so that both right- and left-eye lenses when fitted in an eyeglass frame protrude uniformly from the front side of the frame.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A device for the display of an engravement shape of an eyeglass lens, said device comprising:

means for measuring an edge thickness of each of unmachined eyeglass lenses at a portion of a lens peripheral shape of an eyeglass frame on the basis of data on the lens peripheral shape of the eyeglass frame;

means for judging a type of each of the eyeglass lenses on the basis of the edge thickness and for classifying the eyeglass lenses into groups comprising plus lenses, flat lenses and minus lenses; and a display for displaying an engravement shape of an edge end of each eyeglass lens after each of the eyeglass lenses has been machined along the lens peripheral shape as an estimated engravement shape, and displaying said group of the plus lenses, the flat lenses or the minus lenses to which each eyeglass lens belongs on the basis of the result of the judgment made by said judging means.

2. A method for machining a peripheral edge of an eyeglass lens, said method comprising the steps of:

classifying unmachined right and left eyeglass lenses into groups comprising plus lenses, flat lenses and minus lenses in accordance with edge thicknesses at lens peripheral shape portions of right and left eyeglass lens frame portions of an eyeglass frame;

displaying on a display the group of the plus lenses, the flat lenses or the minus lenses to which the right and left eyeglass lenses belong;

machining a peripheral edge of one of the unmachined eyeglass lenses in accordance with data on one lens peripheral shape of the right and left eyeglass lens frame portions;

then, when a peripheral edge of the other unmachined eyeglass lens is to be machined in accordance with data on the other lens peripheral shape of the right and left eyeglass frame portions, adjusting engravement information at an arbitrary circumferential edge position of the other lens peripheral shape in accordance with information as to which group of the plus lenses, the flat lenses or the minus lenses one eyeglass lens belongs and information as to which group of the plus lenses, the flat lenses or the minus lenses the other eyeglass lens belongs both displayed on said display; and machining the peripheral edge of the other eyeglass lens in accordance with the thus-adjusted engravement information.

3. An apparatus for machining a peripheral edge of an eyeglass lens, said apparatus comprising:

means for measuring an edge thickness of each of unmachined eyeglass lenses at a portion of a lens peripheral shape of an eyeglass frame on the basis of data on the lens peripheral shape of the eyeglass frame;

means for judging a type of each of the eyeglass lenses on the basis of the shape of the edge thickness and for classifying the eyeglass lenses into groups comprising plus lenses, flat lenses and minus lenses;

a display for displaying an engravement shape of an edge end of each eyeglass lens after each of the eyeglass lenses has been machined along the lens peripheral shape as an estimated engravement shape, and displaying said group of the plus lenses, the flat lenses or the minus lenses to which each eyeglass lens belongs on the basis of the result of the judgment made by said judging means;

means for adjusting an engravement information at an arbitrary circumferential edge position of the other lens peripheral shape in accordance with information as to which group of the plus lenses, the flat lenses or the minus lenses one eyeglass lens belongs and information as to which group of the plus lenses, the flat lenses or the minus lenses the other eyeglass lens belongs both displayed on said display; and means for machining a peripheral edge of the other eyeglass lens in accordance with engravement information after the adjustment.

* * * * *